US009683318B2

(12) United States Patent
Baumeler

(10) Patent No.: US 9,683,318 B2
(45) Date of Patent: Jun. 20, 2017

(54) TEXTILE SUBSTRATE OF MULTIPLE DIFFERENT DISPOSABLE AND/OR RECYCLABLE MATERIALS, USE OF SUCH A TEXTILE SUBSTRATE AND METHOD FOR PROCESSING SUCH A TEXTILE SUBSTRATE

(75) Inventor: Alfred Baumeler, Altendorf (CH)

(73) Assignee: CLIMATEX AG, Altendorf (CH)

( * ) Notice: Subject to any disclaimer, the term of this patent is extended or adjusted under 35 U.S.C. 154(b) by 752 days.

(21) Appl. No.: 14/123,356

(22) PCT Filed: Jun. 6, 2012

(86) PCT No.: PCT/CH2012/000125

§ 371 (c)(1),
(2), (4) Date: Feb. 17, 2014

(87) PCT Pub. No.: WO2012/167394

PCT Pub. Date: Dec. 13, 2012

(65) Prior Publication Data

US 2014/0166548 A1 Jun. 19, 2014

(30) Foreign Application Priority Data

Jun. 7, 2011 (EP) ..... 11405266

(51) Int. Cl.
*D03D 15/00* (2006.01)
*D03D 13/00* (2006.01)
(Continued)

(52) U.S. Cl.
CPC ..... *D03D 13/004* (2013.01); *B07B 13/003* (2013.01); *D03D 15/06* (2013.01); *Y10T 428/23979* (2015.04); *Y10T 442/3228* (2015.04)

(58) Field of Classification Search
CPC .... D03D 15/00; D03D 15/0027; D03D 27/08; D03D 1/00; D06B 9/00; D06C 19/00; D06C 29/00
See application file for complete search history.

(56) References Cited

U.S. PATENT DOCUMENTS 2,898,665 A * 8/1959 Salem ..... B60C 9/0042 139/420 R
3,766,002 A * 10/1973 Greif ..... C08J 5/02 156/307.3
(Continued)

FOREIGN PATENT DOCUMENTS

EP 0 069 101 A2 1/1983
EP 0 144 592 A2 6/1985
(Continued)

OTHER PUBLICATIONS

International Search Report for PCT/CH2012/000125 dated Oct. 10, 2013.

*Primary Examiner* — Bobby Muromoto, Jr.
(74) *Attorney, Agent, or Firm* — Pearne & Gordon LLP

(57) ABSTRACT

A textile substrate (1A) includes a warp and a weft and containing several different disposable and/or usable materials. A first subset of the totality of all warp threads and weft threads contains one or more warp threads (K1(1), K2(1), K3(1)) and one or more weft threads (S1(1)), wherein each warp thread of the first subset and each weft thread of the first subset is made of a first of the different disposable materials. A second subset of the totality of all warp threads (K1(2), K2(2), K3(2)) and weft threads contains one or more warp threads and/or one or more weft threads, wherein each warp thread of the second subset and each weft thread of the second subset is made of a second of the different disposable materials. A third subset of the totality of all warp threads and weft threads contains one or more warp threads and/or
(Continued)

one or more weft threads (S1(3)), wherein each warp thread of the third subset and each weft thread of the third subset is made of a material (Z) that can be destroyed by means of a chemical and/or physical method. The warp threads and weft threads of the first and second subsets (K1 (I), K2(1), K3(1), K1(2), K2(2), K3(2)) are arranged in such a way that said warp threads and weft threads are not bound to one another and thus can be separated if the respective warp threads and/or weft threads (S1(3)) of the third subset are destroyed.

32 Claims, 8 Drawing Sheets

(51) Int. Cl.
*D03D 15/06* (2006.01)
*B07B 13/00* (2006.01)
*D03D 1/00* (2006.01)

(56) References Cited

U.S. PATENT DOCUMENTS 3,766,872 A * 10/1973 Krieger ..... D05C 17/00 112/439
3,859,941 A * 1/1975 Krieger ..... D05C 17/00 112/475.18
4,167,485 A * 9/1979 Schenk ..... C08F 220/06 252/8.83
4,312,565 A * 1/1982 Oestreich ..... G02B 6/4434 174/23 R
4,371,584 A * 2/1983 Fahey ..... C03C 25/26 428/392
4,451,175 A * 5/1984 Yamashita ..... E02D 3/10 383/1
4,574,107 A * 3/1986 Ferrari ..... D03D 15/06 427/381
4,578,306 A * 3/1986 Heiman ..... D03D 15/00 139/420 R
4,670,326 A * 6/1987 Heiman ..... D03D 15/00 139/420 A
4,724,183 A * 2/1988 Heiman ..... D03D 15/00 139/420 A
4,726,400 A * 2/1988 Heiman ..... D03D 27/08 139/396
4,729,215 A * 3/1988 Sato ..... D02G 3/38 57/2
4,773,135 A * 9/1988 Sato ..... D02G 3/38 139/397
4,943,374 A * 7/1990 Heininger ..... C12H 1/063 210/500.41
5,060,350 A * 10/1991 Harris ..... B41J 31/02 139/387 R
5,087,327 A * 2/1992 Hood ..... D02G 3/406 139/383 A
5,136,761 A * 8/1992 Sternlieb ..... D06C 29/00 28/104
5,228,175 A * 7/1993 Olry ..... D02G 3/18 28/112
5,240,756 A * 8/1993 Finell ..... B60P 7/04 428/193
5,392,500 A * 2/1995 Olry ..... C04B 35/83 28/112
5,424,117 A * 6/1995 Heiman ..... A61F 13/00008 128/846
5,456,981 A * 10/1995 Olry ..... C04B 35/83 428/359
5,495,874 A * 3/1996 Heiman ..... D03D 15/00 139/420 A
5,507,079 A * 4/1996 Schmidt ..... A61F 13/04 28/170
5,555,716 A * 9/1996 Dugan ..... D02G 3/36 57/210
5,557,831 A * 9/1996 Kishi ..... B29C 70/08 28/167
5,732,749 A * 3/1998 Fargeout ..... B32B 5/26 139/383 A
6,015,618 A * 1/2000 Orima ..... D02G 3/22 428/364
6,251,809 B1 * 6/2001 Creasy ..... B29C 70/14 428/196
6,395,046 B1 * 5/2002 Emig ..... B01D 39/1623 15/347
6,423,165 B1 * 7/2002 Hishinuma ..... A41D 27/08 112/117
6,425,985 B1 * 7/2002 Hagfors ..... D21F 7/083 162/358.2
6,491,794 B2 * 12/2002 Davenport ..... B32B 5/02 139/383 AA
6,679,151 B1 * 1/2004 Rexroad ..... D04C 1/12 57/210
6,803,332 B2 * 10/2004 Andrews ..... D02G 3/12 428/377
6,823,569 B2 * 11/2004 Cohen ..... D02G 3/406 28/168
6,824,871 B2 * 11/2004 Chu ..... B60C 9/0042 156/166
6,875,314 B2 * 4/2005 Korfer ..... D21F 1/0027 162/358.2
7,000,295 B2 * 2/2006 Andrews ..... D02G 3/12 28/168
7,101,404 B2 * 9/2006 Korfer ..... D21F 1/0027 112/403
7,169,718 B1 * 1/2007 Rexroad ..... D04B 21/12 297/452.59
7,294,673 B2 * 11/2007 Kanazawa ..... B01J 20/26 522/149
7,472,961 B2 * 1/2009 Schwartz ..... D02G 3/346 297/451.9
7,507,272 B2 * 3/2009 Emig ..... A47L 9/12 55/527
7,509,690 B2 * 3/2009 Steward ..... A41D 1/04 2/161.1
7,520,121 B2 * 4/2009 Teshima ..... D02G 3/32 57/236
7,673,656 B2 * 3/2010 Heiman ..... D03D 27/08 139/391
7,726,348 B2 * 6/2010 Heiman ..... D03D 15/00 139/383 R
7,807,590 B2 * 10/2010 Takeuchi ..... D02G 3/406 28/168
7,820,728 B2 * 10/2010 Wright ..... B29B 17/02 139/2
7,922,943 B2 * 4/2011 Gerking ..... D01F 2/00 264/40.1
8,375,537 B2 * 2/2013 Liu ..... D02G 3/04 28/165
8,633,027 B2 * 1/2014 Altman ..... A61F 2/08 424/423
8,685,426 B2 * 4/2014 Altman ..... A61F 2/08 424/402
8,715,820 B2 * 5/2014 Klausnitzer ..... A47L 9/14 428/220
9,353,465 B2 * 5/2016 Teshima ..... D02G 3/406
2002/0034902 A1 * 3/2002 Litton ..... A61F 2/06 442/92
2002/0083690 A1 * 7/2002 Emig ..... A47L 9/14 55/382
2002/0139503 A1 * 10/2002 Davenport ..... B32B 5/02 162/358.1
2002/0187345 A1 * 12/2002 Andrews ..... D02G 3/12 428/365
2003/0097704 A1 * 5/2003 Gerber ..... A41D 19/00 2/161.6
2003/0148687 A1 * 8/2003 Korfer ..... D21F 1/0027 442/304

(56) References Cited

U.S. PATENT DOCUMENTS

2003/0192157 A1* 10/2003 Andrews ..... D02G 3/12 28/170
2003/0232557 A1* 12/2003 Korfer ..... D21F 1/0027 442/295
2004/0026058 A1* 2/2004 Watanabe ..... D21F 7/083 162/358.2
2004/0055660 A1* 3/2004 Heiman ..... D03D 15/00 139/420 R
2004/0096658 A1* 5/2004 Chu ..... B60C 9/0042 428/375
2004/0128811 A1* 7/2004 Mandawewala ..... D02G 3/406 28/168
2004/0131821 A1* 7/2004 Mandawewala ..... D02G 3/406 428/97
2004/0172984 A1* 9/2004 Jung ..... D04B 1/16 66/202
2004/0210167 A1* 10/2004 Webster ..... A61B 17/00 601/1
2005/0069685 A1* 3/2005 Andrews ..... D02G 3/12 428/200
2005/0081939 A1* 4/2005 Heiman ..... D03D 27/08 139/25
2005/0095939 A1* 5/2005 Heiman ..... D03D 15/00 442/208
2005/0167069 A1* 8/2005 Kobayashi ..... D21F 7/083 162/358.2
2006/0014721 A1* 1/2006 Zhang ..... A61L 15/28 514/57
2006/0137529 A1* 6/2006 Emig ..... A47L 9/12 96/153
2006/0150378 A1* 7/2006 Andrews ..... D02G 3/12 28/168
2006/0180229 A1* 8/2006 Heiman ..... D03D 15/00 139/420 R
2007/0087162 A1* 4/2007 Mandawewala ..... D02G 3/36 428/97
2007/0190883 A1* 8/2007 Takeuchi ..... D02G 3/406 442/301
2007/0214765 A1* 9/2007 Teshima ..... D02G 3/32 57/293
2008/0005827 A1* 1/2008 Steward ..... A41D 1/04 2/164
2008/0113146 A1* 5/2008 Wright ..... B29B 17/02 428/95
2008/0226886 A1* 9/2008 Klausnitzer ..... A47L 9/14 428/219
2009/0221202 A1* 9/2009 Moller ..... C04B 14/42 442/180
2010/0300576 A1* 12/2010 Liu ..... D02G 3/04 139/35
2011/0111666 A1* 5/2011 Kim ..... D03D 13/008 442/239
2011/0262743 A1* 10/2011 Raidt ..... C09J 7/04 428/343
2013/0037163 A1* 2/2013 Teshima ..... D02G 3/406 139/391
2014/0157990 A1* 6/2014 Piry ..... B01D 46/0028 96/226
2014/0166548 A1* 6/2014 Baumeler ..... D03D 15/06 209/509
2014/0197095 A1* 7/2014 Demmel ..... B01D 39/1623 210/491
2014/0248461 A1* 9/2014 Mandawewala ..... D02G 3/36 428/76
2014/0323999 A1* 10/2014 Bonnefin ..... D02G 3/02 604/319
2014/0367355 A1* 12/2014 Kameyama ..... C25B 13/02 216/7
2015/0068000 A1* 3/2015 Asano ..... D04B 1/04 28/168
2015/0104990 A1* 4/2015 Mandawewala ..... D02G 3/36 442/190
2015/0218737 A1* 8/2015 Blakely ..... D03D 15/06 428/131
2015/0273372 A1* 10/2015 Demmel ..... B01D 39/163 55/482
2015/0283487 A1* 10/2015 Demmel ..... B01D 39/163 210/650

FOREIGN PATENT DOCUMENTS

JP 58-18496 A 2/1983
JP 60-119293 A 6/1985
JP 2000-316696 A 11/2000
JP 2004-060309 A 2/2004
JP 2006-000207 A 1/2006
JP 2009-023452 A 2/2009

* cited by examiner

TEXTILE SUBSTRATE OF MULTIPLE DIFFERENT DISPOSABLE AND/OR RECYCLABLE MATERIALS, USE OF SUCH A TEXTILE SUBSTRATE AND METHOD FOR PROCESSING SUCH A TEXTILE SUBSTRATE

The invention relates to a textile substrate of warp and weft, which comprises a plurality of variously disposable and/or utilisable materials and/or a plurality of disposable and/or utilisable materials selected from various utilisation groups, a use of such a textile substrate and a method for processing such a textile substrate.

Textile substrates are largely designed as consumer goods and are usually disposed of after their planned use so that the materials from which they are made are no longer used or utilised. Mention is made of the disposal at rubbish dumps or also incineration of rubbish. In a few cases, predominantly in the case of textile substrate made of expensive materials, for example, the tearing of the textile substrate (decomposition into the fibre components) has become established as a relatively simple process. In the case of textile substrates made of thermoplastic polymers, thermal forming has proved to be an obvious solution. The aforesaid processes are used for the reprocessing of the used textile substrates and enable re-utilisation of the materials contained in the textile substrate. However, such reprocessing methods are more or less complex and have the property that they certainly lead to a recovery of the respective materials but usually with a reduced quality (compared to the state of the materials during the manufacture of the respective textile substrate). Therefore, if the materials obtained with such a reprocessing method are used again for the manufacture of new textile substrates, these new textile substrates are frequently no longer suitable for a further reprocessing according to the same reprocessing method and must usually be disposed off, for example, in the rubbish or by incineration.

"Recyclable" textile substrates are also known. "Recyclable" in this context means that a re-utilisation of the materials contained in the textile substrate or a return of these materials to nature is possible without needing to accept a loss of quality. As an example, mention is made here of textile substrates which are biologically degradable, bringing benefit to the soil and can therefore pass through a "natural cycle". Another example is textile substrates of materials which can be utilised in a "technical cycle", for example, textile substrates of polyamide 6, which can be returned to a polymeric precursor by means of chemical (accordingly "technical" processes).

Recyclable textile substrates are known which are qualified to be able to circulate in "endless" (i.e. to be carried out repeatedly) natural or technical cycles. Such textile substrates are usually single-variety, for example, constructed of natural fibres or natural chemical fibres, polymers or similar polymer groups (polymers and co-polymers). If these textile substrates contain mixtures of several materials, these materials are usually selected so that all the materials jointly are either biologically degradable (this is the case, for example for a textile substrate made of wool and cellulose regenerate) or however are re-utilisable with a technical process (this is the case, for example, with a textile substrate made of a polymer and a co-polymer).

In the case of textile substrates which are to be suitable for a biological cycle, very high demands are placed on the purity of the fibres contained in the textile substrate and also on the additives used such as dyes and finishing dressings. The requirements which such textile substrates must meet in relation to a biological cycle are approximately as high as the requirements which must be met by foodstuffs. Attempts are made to design a textile substrate in such a manner that it is suitable as a whole for a biological cycle, so that this frequently has the disadvantage that other desired properties of the textile substrate can only be achieved to a certain extent or only with increased expenditure. If, for example, a textile substrate which is to be used as a seat cover is to be made exclusively of natural fibres or of natural chemical fibres or of mixtures of these fibres, in order to ensure that this textile substrate is suitable for a biological cycle, it requires a complex and correspondingly costly construction of the textile substrate in order to ensure that this textile substrate can additionally fulfil high requirements on the chafing resistance which is desired in the case of seat covers.

Textile substrates made of materials which are suitable for processing in a technical cycle (e.g. polymeric materials) are also associated with disadvantages as a result of their material properties with a view to specific functions. Pure polymeric materials cannot, for example, meet the requirements which are to be satisfied by covering materials for seating devices with a view to moisture absorption, buffering of moisture, metered cooling or heat transport, to the desired extent.

Textile substrates are also known which contain fibres of technical origin and also fibres of natural origin. For example, textile substrates are known which contain yarns manufactured by spinning mixtures of fibres of materials of technical origin and fibres of natural origin. In textile substrates of warp and weft, mixtures of materials of natural origin and materials of technical origin are also achieved whereby specific warp threads and/or weft threads are each achieved from a material of natural origin and other warp threads and/or weft threads are achieved from a material of technical origin. Such textile substrates each containing mixtures of different materials are also called "hybrid" and specifically because of the mixture of different materials can cover a particularly broad spectrum of applications. With a view to reprocessing however, the known "hybrids" have the disadvantage that utilisation in natural or technical cycles is rendered difficult or prevented, specifically because of the mixtures of different materials. These textile substrates usually contain a mixture of materials which differ in such a manner that disposal and/or utilisation of the textile substrate as a whole in a single (natural or technical) cycle is usually not possible or is too expensive. Usually with such textile substrates, different materials contained in the mixture must firstly be separated from one another so that the different materials are then processed separately from one another in different processes and can be utilised largely free from undesired additives of other materials. With conventional textile substrates however, such a separation of different materials is usually extremely expensive. Carpets made of pure wool are available which are nevertheless unsuitable for biological utilisation because they can be provided with biologically non-degradable means (e.g. non-degradable dyes or means for stain protection or flame protection). The majority of carpets are made of technical materials. For example, fitted carpets have back structures which usually contain bitumen or polyurethane in combination with polymers such as polyolefins, polyester or even polyamides on the useful side (also called pile side). On account of the different polymers, such carpets are unsuitable for processing in a technical cycle. Only by accepting appreciable expense is it possible to mechanically and/or chemically separate at least certain components such as, for example, the carpet pile from the carpet back and process accordingly.

It is the object of the present invention to avoid the said disadvantages and provide a textile substrate which on the one hand contains a plurality of different materials which are variously disposable and/or utilisable (i.e. separately from one another, e.g. in different cycles) and which enable an inexpensive processing of the textile substrate in which the different materials can be separated from one another in a simple manner so that these materials can be disposed of and/or utilised separately from one another. Furthermore, a use of such a textile substrate and a corresponding method for processing such a textile substrate are to be provided. The various disposable and/or utilisable materials should be able to be selected from various "utilisation groups".

A utilisation group is to be understood in this context as a group of a plurality of materials which are different but can nevertheless be disposed of and/or utilised jointly so that they need not be separated from one another prior to disposal or utilisation.

The said object is solved by a textile substrate having the features of claim 1 (hereinafter "textile substrate according to variant 1") and by a textile substrate having the features of claim 2 ("hereinafter "textile substrate according to variant 2"). Furthermore, the object is solved by a use of the textile substrate according to the invention having the features of claim 21 and by a method having the features of claim 22.

The textile substrate according to variant 1 consists of warp and weft and comprises a plurality of variously disposable and/or utilisable materials or a plurality of disposable and/or utilisable materials selected from various utilisation groups. In this case, the warp comprises a plurality of warp threads and the weft comprises a plurality of weft threads, wherein

- a first subset of the totality of all warp threads and weft threads (hereinafter "the first subset") contains one or a plurality of warp threads and one or a plurality of weft threads and each warp thread of the first subset and each weft thread of the first subset, consists of a first of the variously disposable and/or utilisable materials and/or of a disposable and/or utilisable material selected from a first of the various utilisation groups,
- a second subset of the totality of all warp threads and weft threads (hereinafter "the second subset") contains either one or a plurality of warp threads or both one or a plurality of warp threads and also one or a plurality of weft threads and each warp thread of the second subset, and if the second subset contains one or a plurality of weft threads, each weft thread of the second subset consists of a second of the variously disposable and/or utilisable materials, or of a disposable and/or utilisable material selected from a second of the various utilisation groups,
- each warp thread crosses over a plurality of weft threads, and each weft thread crosses over a plurality of warp threads, such that the warp and the weft together form a layer, which on one side has a first surface and on another side has a second surface located opposite the first surface.

According to the invention, the textile substrate according to variant 1 is configured in such a manner that a third subset of the totality of all warp threads and weft threads (hereinafter "the third subset") contains either one or a plurality of weft threads, or both one or a plurality of warp threads and also one or a plurality of weft threads, and each weft thread of the third subset and, if the third subset contains one or a plurality of warp threads, each warp thread of the third subset, consists of a destructible material. Furthermore, the layer has at least one region through which extend one or a plurality of warp threads of the first subset, one or a plurality of weft threads of the first subset, and one or a plurality of warp threads of the second subset, wherein:

- each individual thread of the said warp threads of the first subset, which extend through the at least one region of the layer, crosses over at least one weft thread of the first subset in the at least one region of the layer, on a side facing towards the second surface, wherein
- each individual thread of the said warp threads of the second subset, which extend through the at least one region of the layer, crosses over each individual thread of the said weft threads of the first subset, which extend through the at least one region of the layer, on a side facing towards the first surface,
- the third subset contains at least one weft thread, which extends through the at least one region of the layer, and is arranged such that the said at least one weft thread of the third subset crosses over, in the at least one region of the layer, at least one warp thread of the first subset, on a side facing towards the second surface, and crosses over at least one warp thread of the second subset, on a side facing towards the first surface, such that the said at least one warp thread of the second subset, in the at least one region of the layer, is bound to the first subset,
- the destructible material of the at least one weft thread of the third subset can be destroyed by means of a chemical and/or physical method, such that the second subset, in the at least one region of the layer, is no longer bound to the first subset.

The textile substrate accordingly contains at least two variously disposable and/or utilisable materials or a plurality of materials selected from at least two different utilisation groups. In this context it is relevant that the respectively variously disposable and/or utilisable materials are each present in the textile substrate in different warp threads and/or different weft threads. As a result, the variously disposable and/or utilisable materials are spatially separated in the textile substrate, i.e. distributed among various warp and/or weft threads. In order to separate the various disposable and/or utilisable materials, it is sufficient for example to be able to separate the respective warp and/or weft threads.

In this case it is assumed that the respective warp threads and weft threads which pertain to the first subset of the totality of all the warp and weft threads (i.e. "the warp threads and weft threads of the first subset") are each disposable and/or utilisable jointly. Likewise respective warp threads and weft threads which pertain to the second subset of the totality of all the warp and weft threads (i.e. "the warp threads and weft threads of the second subset") are each disposable and/or utilisable jointly. On the other hand, the respective warp threads and weft threads of the first subset and the respective warp threads and/or weft threads of the second subset are each disposable and/or utilisable in different ways, e.g. in different cycles.

According to the invention, the respective warp threads and weft threads of the first subset and the warp threads and/or weft threads of the second subset are arranged in the at least one region of the layer in a particular manner relative to one another and relative to the first surface and to the second surface. Since each individual one of the warp threads of the second subset which extend through the at least one region of the layer crosses over each individual one of those weft threads of the first subset which extend through the at least one region of the layer, on a side facing the first surface, it is achieved that the respective warp threads of the second subset in the at least one region cross over the respective warp threads of the first subset exclusively on the same side, and accordingly in the at least one region are not bound by the respective weft threads of the first subset or held in the textile substrate.

Since each individual one of those warp threads of the first subset which extend through the at least one region of the layer crosses over at least one weft thread of the first subset in the at least one region of the layer on a side facing the second surface, it is additionally achieved that the respective warp threads of the first subset and the respective warp threads of the second subset in the at least one region cross over respectively at least one weft thread of the first subset on different sides. Since the weft threads of the first subset cross over the warp threads of the first subset and the warp threads of the second subset, this type of crossing in warp and weft has the effect that in the at least one region the respective weft threads of the first subset bring about a spatial division (separation) between the respective warp threads of the first subset and the respective warp threads of the second subset. This spatial separation is an essential requirement for the respective warp threads and weft threads of the first subset being able to be separated from the respective warp threads in a simple manner.

According to the invention, the third subset of the totality of warp threads and weft threads has the function of binding the warp threads and weft threads of the first subset and the warp threads and/or weft threads of the second subset to one another in the at least one region. In the case of the textile substrate according to variant 1, this binding is achieved whereby the third subset contains at least one weft thread which extends through the at least one region of the layer and is arranged in such a manner that this at least one weft thread of the third subset in the at least one region of the layer crosses over at least one warp thread of the first subset on a side facing the second surface and crosses over at least one warp thread of the second subset on a side facing the first surface. This at least one weft thread of the third subset delimits in the at least one region the respective warp threads of the first subset and the respective warp threads of the second subset between the first surface and the second surface of the layer and accordingly provides a condition for the warp and weft threads of the first subset and the respective warp and/or weft threads of the second subset to be held in the at least one region in the layer and therefore held together jointly in the layer.

Since each warp thread of the third subset or each weft thread of the third subset consists of a destructible material and the destructible material of the at least one weft thread of the third subset can be destroyed by means of a chemical and/or physical method in such a manner that the second subset in the at least one region of the layer is no longer bound to the first subset, it is achieved that by application of the respective chemical and/or physical method, the textile substrate goes over into a state which in the at least one region allows a spatial separation of the respective warp threads and weft threads of the first subset from the respective warp threads of the second subset. If the at least one weft thread of the third subset in the textile substrate is destroyed by application of the chemical and/or physical method, the respective warp threads of the first subset and the second subset which are bound to one another in the textile substrate by means of the at least one weft thread of the third subset, can now be separated mechanically in the at least one region. Since the respective warp threads of the second subset in the at least one region cross over the weft threads of the first subset on a side facing the first surface, after destruction of the at least one weft thread of the third subset in the at least one region, the respective warp threads of the second subset can be removed from the respective warp threads and weft threads of the first subset in the direction of the first surface and thus separated.

The textile substrate according to variant 2 consists of warp and weft and comprises a plurality of variously disposable and/or utilisable materials or a plurality of disposable and/or utilisable materials selected from various utilisation groups. In this case, the warp comprises a plurality of warp threads and the weft comprises a plurality of weft threads, wherein

- a first subset of the totality of all warp threads and weft threads (hereinafter "the first subset") contains one or a plurality of warp threads and one or a plurality of weft threads and each warp thread of the first subset and each weft thread of the first subset, consists of a first of the variously disposable and/or utilisable materials and/or of a disposable and/or utilisable material selected from a first of the various utilisation groups,
- a second subset of the totality of all warp threads and weft threads (hereinafter "the second subset") contains either one or a plurality of weft threads or both one or a plurality of warp threads and also one or a plurality of weft threads and each warp thread of the second subset, and if the second subset contains one or a plurality of weft threads, each weft thread of the second subset consists of a second of the variously disposable and/or utilisable materials, or of a disposable and/or utilisable material selected from a second of the various utilisation groups, each warp thread crosses over a plurality of weft threads, and each weft thread crosses over a plurality of warp threads, such that the warp and the weft together form a layer, which on one side has a first surface and on another side has a second surface located opposite the first surface.

According to the invention, the textile substrate according to variant 2 is configured in such a manner that a third subset of the totality of all warp threads and weft threads contains either one or a plurality of warp threads, or both one or a plurality of warp threads and also one or a plurality of weft threads, and each warp thread of the third subset and, if the third subset contains one or a plurality of weft threads, each weft thread of the third subset, consists of a destructible material. Furthermore, the layer has at least one region through which extend one or a plurality of warp threads of the first subset, one or a plurality of weft threads of the first subset, and one or a plurality of weft threads of the second subset, wherein:

- each individual thread of the said weft threads of the first subset, which extend through the at least one region of the layer, crosses over at least one warp thread of the first subset in the at least one region of the layer, on a side facing towards the second surface, wherein
- each individual thread of the said weft threads of the second subset, which extend through the at least one region of the layer, crosses over each individual thread of the said warp threads of the first subset, which extend through the at least one region of the layer, on a side facing towards the first surface,
- the third subset contains at least one warp thread, which extends through the at least one region of the layer, and is arranged such that the said at least one warp thread of the third subset crosses over, in the at least one region of the layer, at least one weft thread of the first subset, on a side facing towards the second surface, and crosses over at least one weft thread of the second subset, on a side facing towards the first surface, such that the said at least one weft thread of the second subset, in the at least one region of the layer, is bound to the first subset, the destructible material of the at least one warp thread of the third subset can be destroyed by means of a chemical and/or physical method, such that the second subset, in the at least one region of the layer, is no longer bound to the first subset.

The textile substrate according to variant 2 differs from the textile substrate according to variant 1 substantially in that the arrangement or the function of the respective weft threads in the textile substrate according to variant 2 corresponds to the arrangement or the function of the respective warp threads in the textile substrate according to variant 1 and the arrangement or the function of the respective warp threads in the textile substrate according to variant 2 corresponds to the arrangement or the function of the respective weft threads in the textile substrate according to variant 1. The properties and advantages which are mentioned above in relation to the warp threads or the weft threads of the textile substrate according to variant 1 therefore correspond similarly to the properties and advantages which are to be assigned to the weft threads or the warp threads of the textile substrate according to variant 2. Unlike the textile substrate according to variant 1, the third subset of the totality of all the warp threads and weft threads contains at least one warp thread of a destructible material which has the effect that warp threads of the first subset and warp threads of the second subset are bound to one another in the at least one region of the layer as long as the at least one warp thread of the third subset is not destroyed. However if the at least one warp thread of the third subset is destroyed during an application of the chemical and/or physical method, the weft threads of the second subset in the at least one region are no longer bound to the weft threads of the first subset so that the weft threads of the second subset in the at least one region can be separated from the warp threads and weft threads of the first subset (similarly to the separation of the warp threads of the second subset in the case of the textile substrate according to variant 1).

One embodiment of the textile substrate according to variant 1 is characterised in that the second subset contains a plurality of warp threads which extend through the at least one region of the layer and the second subset contains at least one weft thread, wherein the said at least one weft thread of the second subset extends through the at least one region of the layer and, in the at least one region of the layer, crosses over one or a plurality of warp threads of the second subset on a side facing towards the first surface, and crosses over one or a plurality of warp threads of the second subset on a side facing towards the second surface, wherein each of the said warp threads of the second subset, which extend through the at least one region of the layer, is crossed over on the side facing towards the first surface by at least one of the following weft threads: (i) the at least one weft thread of the second subset, (ii) the at least one weft thread of the third subset. In the case of this embodiment, a plurality of warp threads of the second subset in the at least one region of the layer can be held in the layer by one or a plurality of weft threads crossing over the warp threads of the second subset on the side facing the first surface. However, for this purpose the at least one weft thread of the third subset need not cross over all the warp threads of the second subset on the side facing the first surface. Those warp threads of the second subset which are crossed over by the at least one weft thread of the second subset which extends through the at least one region of the layer on a side facing the first surface can also be held exclusively by this at least one weft thread of the second subset in the at least one region of the layer, wherein this at least one weft thread of the second subset in the at least one region of the layer is held whereby it crosses over one or a plurality of warp threads of the second subset on a side facing the first surface and one or a plurality of warp threads of the second subset on a side facing the second surface. Alternatively a warp thread of the second subset in the at least one region of the layer can also be crossed over both by the at least one weft thread of the third subset and also by the at least one weft thread of the second subset on the side facing the first surface and therefore held securely in the at least one region of the layer. If the at least one warp thread of the third subset is destroyed, then the warp threads of the second subset and the at least one weft thread of the second subset in the at least one region of the layer can be removed from the respective warp threads and weft threads of the first subset in the direction of the first surface and thereby separated. In the present case, the warp threads of the second subset and the at least one weft thread of the second subset after destruction of the at least one weft thread of the third subset can be separated individually from the respective warp threads and weft threads of the first subset, especially as the warp threads of the second subset are merely crossed over by the at least one weft thread of the second subset on one side and consequently cannot be held together by the at least one weft thread in such a manner that the warp threads of the second subset and the at least one weft thread of the second subset jointly form a stable flatly configured unit.

A further development of the aforesaid embodiment of the textile substrate according to variant 1 is characterised in that the first subset contains a plurality of warp threads which extend through the at least one region of the layer and which the at least one weft thread of the third subset crosses over, in the at least one region of the layer, on a side facing towards the second surface, and the first subset contains one or a plurality of weft threads, which extend through the at least one region of the layer, and in the at least one region of the layer, cross over the said warp threads of the first subset, which extend through the at least one region of the layer, on a side facing towards the first surface. In this case, the warp threads of the first subset in the at least one region of the layer are each bound by the at least one weft thread of the third subset to the warp threads and weft threads of the second subset. If the at least one weft thread of the third subset is destroyed by an application of the chemical and/or physical method, then the respective warp threads and weft threads of the first subset in the at least one region of the layer are no longer bound to the warp threads and weft threads of the second subset. In this case, the warp threads of the first subset are spatially separated from the warp threads of the second subset by the weft threads of the first subset, especially as the weft threads of the first subset in the at least one region of the layer cross over the warp threads of the second subset on a side facing the second surface and the warp threads of the first subset. After the destruction of the at least one weft threads of the third subset, the respective warp threads and weft threads of the first subset in the at least one region of the layer can be removed from the respective warp threads and weft threads of the second subset in the direction of the second surface and therefore separated. In the present case, the warp threads and weft threads of the first subset can be separated individually from the respective warp threads and weft threads of the second subset, especially as the warp threads of the first subset are crossed over by the weft threads of the first subset in each case on the same side and consequently cannot be held together by the weft threads of the first subset in such a manner that warp threads and weft threads of the first subset jointly form a stable, flatly configured unit.

A further embodiment of the textile substrate according to variant 1 is characterised in that the first subset contains a plurality of warp threads, which extend through the at least one region of the layer, and the first subset contains at least two weft threads which extend through the at least one region of the layer, wherein each of the at least two weft threads of the first subset crosses over, in the at least one region of the layer, one or a plurality of the warp threads of the first subset on a side facing towards the first surface and crosses over one or a plurality of the warp threads of the first subset on a side facing towards the second surface such that each individual thread of the said warp threads of the first subset, which extend through the at least one region of the layer, in the at least one region of the layer, on the side facing towards the first surface, is crossed over by one of the at least two weft threads of the first subset, and, on the side facing towards the second surface, is crossed over by the other of the at least two weft threads of the first subset. In this case, the warp threads and weft threads of the first subset cross over each other in the at least one region of the layer in such a manner that the warp threads and weft threads of the first subset jointly form a stable flatly configured unit. By means of the at least one weft thread of the third subset, this unit as a whole is bound to the respective warp threads and weft threads of the second subset and after destruction of the at least one weft thread of the third subset, can be removed from the warp threads and weft threads of the second subset in the direction of the second surface. The latter considerably simplifies a separation of the second subset.

A further development of the aforesaid embodiment of the textile substrate according to variant 1 is characterised in that the second subset contains a plurality of warp threads which extend through the at least one region of the layer and are crossed over by the at least one weft thread of the third subset on a side facing the first surface. In this case also, the warp threads and weft threads of the first subset cross over each over in the at least one region of the layer in such a manner that the warp threads and weft threads of the first subset jointly form a stable flatly configured unit. All the warp threads of the second subset in the at least one region of the layer are individually bonded to this unit by means of the at least one weft thread of the third subset. If the at least one weft thread of the third subset is destroyed by application of the chemical and/or physical method, the warp threads of the second subset can be separated individually from the warp threads and weft threads of the first subset and removed. Consequently in the present case after destruction of the at least one weft thread of the third subset in the at least one region of the layer, the textile substrate can be decomposed into individual warp threads of the second subset and the said unit formed from the warp threads and weft threads of the first subset which cross over each other.

Another further development of the aforesaid embodiment of the textile substrate according to variant 1 is characterised in that the second subset contains a plurality of warp threads which extend through the at least one region of the layer, and the second subset contains at least one weft thread wherein the said at least one weft thread of the second subset extends through the at least one region of the layer, and, in the at least one region of the layer, crosses over one or a plurality of warp threads of the second subset on a side facing towards the first surface, and crosses over one or a plurality of warp threads of the second subset on a side facing towards the second surface, wherein each of the said warp threads of the second subset, which extend through the at least one region of the layer, is crossed over on the side facing towards the first surface by at least one of the following weft threads: (i) the at least one weft thread of the second subset, (ii) the at least one weft thread of the third subset. In this case also, the warp threads and weft threads of the first subset cross over each other in the at least one region of the layer in such a manner that the warp threads and weft threads of the first subset jointly form a stable flatly configured unit. The respective warp threads of the second subset in the at least one region of the layer are bound to this unit by one or a plurality of weft threads which cross over the warp threads of the second subset on the side facing the first surface. However for this purpose, the at least one weft thread of the third subset need not cross over all the warp threads of the second subset on the side facing the first surface. Those warp threads of the second subset which are crossed over by the at least one weft thread of the second subset, which extend through the at least one region of the layer, on a side facing the first surface, can also be held exclusively by this at least one weft thread of the second subset in the at least one region of the layer, wherein this at least one weft thread of the second subset is held in the at least one region of the layer whereby it crosses over one or a plurality of warp threads of the second subset on a side facing the first surface and one or a plurality of warp threads of the second subset on a side facing the second surface. Alternatively a warp thread of the second subset in the at least one region of the layer can be crossed over both by the at least one weft thread of the third subset and also by the at least one weft thread of the second subset on the side facing the first surface and can therefore be held in the at least one region of the layer. If the at least one weft thread of the third subset is destroyed, the warp threads of the second subset and the at least one weft thread of the second subset in the at least one region of the layer can then be removed from the respective warp threads and weft threads of the first subset in the direction of the first surface and therefore separated. In the present case, after destruction of the at least one weft thread, the warp threads of the second subset and the at least one weft thread of the second subset can be separated individually from the respective warp threads and weft threads of the first subset, especially as the warp threads of the second subset are each only crossed over by the at least one weft thread of the second subset only on one side and consequently are not held together by the at least one weft thread of the second subset in such a manner that the warp threads of the second subset and the at least one weft thread of the second subset jointly form a stable flatly configured unit. Consequently in the present case after destruction of the at least one weft thread of the third subset in the at least one region of the layer, the textile substrate can be decomposed into individual warp threads and weft threads of the second subset and the said unit formed from the warp threads and weft threads of the first subset crossing over each other.

Another further development of the aforesaid embodiment of the textile substrate according to variant 1 is characterised in that the second subset contains a plurality of warp threads which extend through the at least one region of the layer and the second subset contains at least two weft threads, which extend through the at least one region of the layer, wherein each of the at least two weft threads of the second subset in the at least one region of the layer crosses over one or a plurality of warp threads of the second subset on a side facing the first surface and one or a plurality of warp threads of the second subset on a side facing the second surface so that each individual one of the warp threads of the second subset which extends through the at least one region of the layer, in the at least one region of the layer on the side facing the first surface is crossed over by one of the at least two weft threads of the second subset and on the side facing the second surface is crossed over by the other of the at least two weft threads of the second subset, and the at least one weft thread of the third subset crosses over one or plurality of those warp threads of the second subset which extend through the at least one region of the layer on the side facing the first surface and one or a plurality of those warp threads of the first subset which extend through the at least one region of the layer on a side facing the second surface.

In this case, the warp threads and weft threads of the first subset in the first region of the layer cross each other in such a manner that the warp threads and weft threads of the first subset jointly form a stable flatly configured unit—hereinafter called "first unit". Correspondingly the warp threads and weft threads of the second subset in the at least one region of the layer cross each other in such a manner that the warp threads and weft threads of the second subset jointly form a stable flatly configured unit—hereinafter called "second unit". The warp threads of the first subset or the second subset contained in these two units are crossed by the at least one weft thread of the third subset in such a manner that the two unit are bound to one another in the at least one region of the layer. Consequently in the present case, after destruction of the at least one weft thread of the third subset in the at least one region of the layer, the textile substrate can be decomposed into the said "first unit" formed from the warp threads and weft threads of the first subset crossing each other and into the said "second unit" formed from the warp threads and weft threads of the second subunit crossing each other. In this way, the first and the second subset can be separated from one another particularly efficiently.

Various embodiment of the textile substrate according to variant 2 are mentioned in the following, which differ from the already-mentioned embodiments of the textile substrate according to variant 1 in that the arrangement or the function of the respective weft threads in the embodiments of the textile substrate according to variant 2 correspond to the arrangement or the function of the respective warp threads in the embodiments of the textile substrate according to variant 1 and the arrangement or the function of the respective warp threads in the embodiments of the textile substrate according to variant 2 correspond to the arrangement or the function of the respective weft threads in the embodiments of the textile substrate according to variant 1. The properties and advantages mentioned above in relation to the warp threads or the weft threads of the embodiments of the textile substrate according to variant 1 consequently correspond similarly to the properties and advantages which are to be assigned to the weft threads or the warp threads of the embodiments of the textile substrate according to variant 2.

One embodiment of the textile substrate according to variant 2 is characterised in that the second subset contains a plurality of weft threads which extend through the at least one region of the layer and the second subset contains at least one warp thread, wherein the said at least one warp thread of the second subset extends through the at least one region of the layer and, in the at least one region of the layer, crosses over one or a plurality of weft threads of the second subset on a side facing towards the first surface, and crosses over one or a plurality of weft threads of the second subset on a side facing towards the second surface, wherein each of the said weft threads of the second subset, which extend through the at least one region of the layer, is crossed over on the side facing towards the first surface by at least one of the following warp threads: (i) the at least one warp thread of the second subset, (ii) the at least one warp thread of the third subset.

A further development of the aforesaid embodiment of the textile substrate according to variant 2 is characterised in that the first subset contains a plurality of weft threads which extend through the at least one region of the layer and which the at least one warp thread of the third subset crosses over, in the at least one region of the layer, on a side facing towards the second surface, and the first subset contains one or a plurality of warp threads, which extend through the at least one region of the layer, and in the at least one region of the layer, cross over the said weft threads of the first subset, which extend through the at least one region of the layer, on a side facing towards the first surface.

A further embodiment of the textile substrate according to variant 2 is characterised in that the first subset contains a plurality of weft threads, which extend through the at least one region of the layer, and the first subset contains at least two warp threads which extend through the at least one region of the layer, wherein each of the at least two warp threads of the first subset crosses over, in the at least one region of the layer, one or a plurality of the weft threads of the first subset on a side facing towards the first surface and crosses over one or a plurality of the weft threads of the first subset on a side facing towards the second surface such that each individual thread of the said weft threads of the first subset, which extend through the at least one region of the layer, in the at least one region of the layer, on the side facing towards the first surface, is crossed over by one of the at least two warp threads of the first subset, and, on the side facing towards the second surface, is crossed over by the other of the at least two warp threads of the first subset.

A further development of the aforesaid embodiment of the textile substrate according to variant 2 is characterised in that the second subset contains a plurality of weft threads which extend through the at least one region of the layer and which are crossed over by the at least one warp thread of the third subset on a side facing the first surface.

A further development of the aforesaid embodiment of the textile substrate according to variant 2 is characterised in that the second subset contains a plurality of weft threads which extend through the at least one region of the layer and the second subset contains at least one weft thread, wherein this at least one warp thread of the second subset extends through the at least one region of the layer and in the at least one region of the layer crosses over one or a plurality of weft threads of the second subset on a side facing the first surface and crosses over one or a plurality of weft threads of the second subset on a side facing the second surface wherein each individual one of the weft threads of the second subset which extends through the at least one region of the layer, on the side facing the first surface is crossed over by at least one of the following warp threads: (i) the at least one warp thread of the second subset (ii) the at least one warp thread of the third subset.

Another further development of the aforesaid embodiment of the textile substrate according to variant 2 is characterised in that the second subset contains a plurality of weft threads which extend through the at least one region of the layer and the second subset contains at least two warp threads which extend through the at least one region of the layer wherein each of the at least two warp threads of the second subset in the at least one region of the layer crosses over one or a plurality of weft threads of the second subset on a side facing the first surface and crosses over one or a plurality of weft threads of the second subset on a side facing the second surface so that each individual one of those weft threads of the second subset which extends through the at least one region of the layer, in the at least one region of the layer on the side facing the first surface is crossed over by one of the at least two warp threads of the second subset and on the side facing the second surface is crossed over by the other of the at least two warp threads of the second subset and the at least one warp thread of the third subset crosses over one or a plurality of those weft threads of the second subset which extend through the at least one region of the layer on the side facing the first surface and crosses over one or a plurality of those weft threads of the first subset which extends through the at least one region of the layer on a side facing the second surface.

For a person skilled in the art it is obvious that a textile substrate can have both the features of the textile substrate according to the invention according to variant 1 or an embodiment of this textile substrate and also the features of the textile substrate according to the invention according to variant 2 or an embodiment of this textile substrate. In this case, it is feasible that a textile substrate is formed in one region according to the at least one region of the textile substrate according to the invention according to variant 1 and accordingly there has at least one weft thread of the third subset and in another region is formed according to the at least one region of the textile substrate according to the invention according to variant 2 and accordingly there has at least one warp thread of the third subset. Alternatively it is also feasible that a textile substrate is formed in one single region according to the at least one region of the textile substrate according to the invention according to variant 1 or an embodiment of this textile substrate and according to the at least one region of the textile substrate according to the invention according to variant 2 or an embodiment of this textile substrate and accordingly there has at least one weft thread of the third subset and one warp thread of the third subset.

Within the framework of the invention it is also feasible that the warp threads and weft threads of the first subset and the warp threads and/or weft threads of the second subset are bound to one another outside the at least one region, for example by adhesive bonding or by suitable crossovers between the warp threads and weft threads which bring about bondings between the warp threads and weft threads outside the at least one region. In this case, after destruction of the at least one weft thread, the warp threads and weft threads of the first subset and the warp threads and/or weft threads of the second subset could be separated from one another if parts of the textile substrate outside the at least one region are removed or bonds which may be present outside the at least one region are released or removed.

Furthermore, the invention can also be interpreted so that the "at least one region" is identical to the entire textile substrate.

The warp and/or weft threads of the third subset can fundamentally consist of materials which can be destroyed by a chemical and/or physical method which can be applied to the textile substrate as a whole where, after application of the chemical and/or physical method, the warp threads and weft threads of the first and second subset should be in a state which allows the warp threads and weft threads of the first subset to be separated from the warp threads and weft threads of the second subset and to be disposed of or utilised separately, as desired.

One of the following chemical and/or physical methods or a combination of these methods can be used to destroy the destructible material of the weft threads or the warp threads of the third subset:

(i) subjection of the textile substrate, or parts of the textile substrate, to a solvent, wherein the weft thread or the warp thread of the third subset consists of a material that dissolves in the solvent;

ii) subjection of the textile substrate, or parts of the textile substrate, to a solvent, and heating of the textile substrate and/or the solvent to a prescribed temperature, wherein the weft thread, or the warp thread, of the third subset consists of a material that dissolves in the solvent at the prescribed temperature;

(iii) subjection of the textile substrate, or parts of the textile substrate, to a solvent, and heating of the textile substrate and/or the solvent to a prescribed temperature at a prescribed pressure, wherein the weft thread, or the warp thread, of the third subset consists of a material that dissolves in the solvent at the prescribed temperature and the prescribed pressure;

(iv) heating the textile substrate or parts of the textile substrate to a prescribed temperature, wherein the weft thread, or the warp thread, of the third subset consists of a material that melts, and/or decomposes, and/or glazes and/or becomes brittle, at the prescribed temperature;

(v) cooling of the textile substrate down to a prescribed temperature, wherein the weft thread or the warp thread, of the third subset consists of a material that becomes brittle and/or suffers a cold fracture and/or disintegrates, and/or shatters, at the prescribed temperature.

The methods according to (i)-(v) or combinations of these methods can be applied in particular within the framework of the invention when the weft threads or the warp threads of the third subset consist of one or the following materials or a mixture of the following materials: polyvinyl alcohol, starch, polylactide, copolyamide, copolyester, copolyolefins, acetate, polyolefins.

Particularly flexible applications of the textile substrate according to the invention are possible when the warp threads and/or weft threads of the third subset consist of polyvinyl alcohol (also known under the abbreviation PVA or PVOH). PVA is available in the form of fibres and is suitable for the manufacture of yarns e.g. for spinning yarn of staple fibres and for endless yarn and for the manufacture of twisted yarns. Such PVA fibres exist in various embodiments and—depending on the embodiment—are soluble under various conditions, e.g. in water. For example, various types of PVA fibres are available (e.g. available under the trade name "Solvron" from NOTIVY Ltd. Tokyo, Japan) which (depending on the degree of crystallisation) can be soluble at various temperatures in the range from about 30° C. (in cold water) up to about 100° C. (in hot water).

Accordingly, in the case of the textile substrate according to the invention, if the respective warp and weft threads of the third subset are made of PVA, these warp and weft threads can then be removed from the textile substrate by dissolving in water, e.g. by washing the textile substrate in water at a suitably selected temperature. PVA further has the advantage that it can be transferred without further after treatment of the washing water to local clarification plants and can be recovered from the washing water.

With a view to the question as to which types of PVA fibres are most suitable for the textile substrate according to the invention, the purpose for which the textile substrate is to be used is worth noting among other things. PVA fibres which can be dissolved in water at a low temperature have the advantage that they can be removed by particularly simple means, for example, by commercially available washing machines. On the other hand, the stability of the textile substrate according to the invention is endangered if the warp threads and/or weft threads of the third subset can be damaged at temperatures which can occur during normal use of the textile substrate, for example, by spilled hot drinks or steam for smoothing the textile substrate. In order to ensure a particularly high stability of the textile substrate, it is advantageous to fabricate the warp threads and/or weft threads from a type of PVA which is soluble in water at high temperatures. For example, PVA fibres which are soluble by boiling in water at a temperature of about 105-110° C. at a pressure of about 0.5-1 bar have proved successful for this purpose. This has the advantage on the one hand that suitable technical installations for carrying out such a boiling process are available worldwide so that textile substrates according to the invention could be treated worldwide with existing installations in order to destroy warp threads or weft threads of the third subset consisting of such PVA fibres. Furthermore, warp threads or weft threads of the third subset consisting of such PVA fibres can reliably hold together the warp threads and/or weft threads of the first subset and the second subset during the entire usage cycle of the textile substrate according to the invention. In particular normal laundry of the textile substrate in the household is readily possible at low and medium temperatures. Depending on the application, PVA types which are soluble at temperatures below 105° C. can be used for warp threads and weft threads of the third subset. For example, PVA types which could already be dissolved in a boil wash, i.e. using a commercially available washing machine could be used. On the other hand, PVA types which are soluble at temperatures below 60° C. are not suitable since the textile substrate could otherwise be damaged during use.

If the warp threads and/or weft threads of the third subset consist of starch, these warp threads and weft threads can then be dissolved in water, for example, by boiling the textile substrate in water (possibly under pressure).

If the warp threads and/or weft threads of the third subset consist of polylactide, these warp threads and weft threads can be destroyed in the textile substrate according to the invention if the textile substrate is heated, for example, to temperatures of about 170° C., for example, by infrared radiation. The polylactide in this case becomes brittle and can possibly decompose. After heating the textile substrate, the warp threads and/or weft threads of the third subset can be decomposed by mechanical stresses into a plurality of small particles, which can be released from the textile substrate. The warp threads and/or weft threads of the third subset can be removed particularly efficiently from the textile substrate if the textile substrate—after heating—is moved in a solvent, for example, by washing in an alkaline solution. This process can be carried out, for example in a conventional domestic washing machine at temperatures of 60-95° C.

If the warp threads and/or weft threads of the third subset consist of co-polyamide or co-polyester, these warp threads and/or weft threads can then be destroyed by heating the textile substrate. Co-polyamide and co-polyester have a relatively low melting point (for example, compared to polyamide or polyester) so that the textile substrate must merely be heated above the melting point of co-polyamide or co-polyester in order to destroy the warp threads and/or weft threads of the third subset.

If the warp threads and/or weft threads of the third subset consist of co-polyolefins or acetate, these warp threads and/or weft threads can, for example, be dissolved in a solvent. Warp threads and/or weft threads of co-polyolefins can, for example, be dissolved by washing the textile substrate in tetrachloroethylene at 60-70° C. Warp threads and/or weft threads made of acetate can, for example, be dissolved by washing the textile substrate in acetone.

If the warp threads and/or weft threads of the third subset consist of polyolefins, these warp threads and/or weft threads can be destroyed, for example, by deep freezing the textile substrate. The deep freezing in this case leads to an embrittlement of the warp threads and/or weft threads of the third subset so that these warp threads can be destroyed by mechanical splintering.

The textile substrate according to the invention can contain a plurality of different materials in combination with one another, which are preferably suitable for implementing such a textile substrate, can be classified into a plurality of utilisation groups which comprise jointly disposable and/or utilisable materials. Table 1 gives an example for the classification into utilisation groups.

TABLE 1

Utilisation groups

| No. | Designation | Material |
|---|---|---|
| 1 | Natural fibres | e.g. wool, cotton, linen, ramie |
| 2 | Mineral fibres | e.g. glass, carbon, basalt, asbestos |
| 3 | Metals | e.g. copper, aluminium and aluminium alloys, chromium steel, tin, brass |
| 4 | Natural chemical fibres | e.g. cellulose regenerates (viscose (VI), modal (MOD), lyocel/tencel (LYC)), acetate, triacetate |
| 5 | Chemical fibres | e.g. polyester, polyamide, polyolefins, acrylic, aramide-aromatic polyamide (e.g. high-strength kevlar) |

The materials which belong to different utilisation groups mentioned in Table 1 usually have different properties which can contribute to the optimisation of various technical functions of the textile substrate according to the invention.

The materials of utilisation group No. 1 (natural fibres) and utilisation group 4 (natural chemical fibres) are, for example, moisture-regulating and therefore suitable for imparting to the textile substrate a body-friendly physiologically pleasant effect.

The materials of utilisation group No. 2 (mineral fibres) and utilisation group No. 3 (metals) are particularly relevant for technically functional applications of textile substrates.

The materials of utilisation group No. 5 (chemical fibres) are particularly important for the technical performance of the textile substrate, for example, in regard to abrasion resistance.

Whereas the materials of utilisation group No. 1 (natural fibres) and utilisation group 4 (natural chemical fibres) can be utilised, for example, in biological cycles, the materials of the remaining utilisation groups can be utilised in various technical cycles.

The textile substrate according to the invention therefore has the advantage that a plurality of variously disposable and/or utilisable materials or a plurality of disposable and utilisable materials selected from different utilisation groups can be combined in a single substrate and can be held together by means of the destructible warp threads and/or weft threads of the third subset in one layer. Various combinations of materials can be selected here in order to specifically optimise properties of the textile substrate as desired. After destroying the destructible warp threads and/or weft threads of the third subset, the respective warp threads and weft threads of the first subset and the respective warp threads and weft threads of the second subset are present in an arrangement which allows a simple cost-effective separation of the respective variously disposable and/or utilisable materials or the materials selected from the various utilisation groups.

A further embodiment of the textile substrate according to the invention is characterised in that the first of the variously disposable and/or utilisable materials is a natural fibre or a natural chemical fibre or a material which can be disposed of and/or utilised in a biological cycle or the first of the various utilisation groups comprises natural fibres and/or natural chemical fibres and/or materials that can be utilised in a biological cycle. This textile substrate offers the advantage that one side of the textile substrate (the second surface) can be optimised in regard to a body-friendly, physiologically pleasant effect. The other side of the textile substrate (the first surface) can be optimised in another respect—by a suitable choice of the materials of the warp and/or weft threads of the second subset.

A further embodiment of the textile substrate according to the invention is characterised in that the second of the variously disposable and/or utilisable materials consists of a synthetic material or a material which can be disposed of and/or utilised in a technical cycle or the second of the various utilisation groups comprises synthetic materials or materials which can be disposed of and/or utilised in a technical cycle.

A further embodiment of the textile substrate according to the invention is characterised in that the first of the variously disposable and/or utilisable materials and the second of the variously disposable and/or utilisable materials can be disposed of and/or utilised in various technical cycles or each of the materials of the various utilisation groups can be disposed of and/or utilised in various technical cycles.

The textile substrate according to the invention furthermore has the advantage that it can be produced by means of a plurality of techniques. The textile substrate can, for example, be embodied as a woven fabric in dobby weaving technology, jacquard technology, leno technology, pile technology, wire weaving technology or broché weaving technology.

Since the textile substrate according to the invention contains various materials, it can be optimised for many applications and can therefore be used flexibly. The textile substrate according to the invention is particularly suitable as a seat cover textile, a furnishing textile, a clothing textile, a functional textile, a protective textile, a safety textile, a wall covering textile, a floor covering textile or a medicinal textile or as a component of a seat cover textile, a furnishing textile, a clothing textile, a functional textile, a protective textile, a safety textile, a wall covering textile, a floor covering textile or a medicinal textile.

The object forming the basis of the invention is also solved by a method for processing a textile substrate according to the invention comprising the following steps:

execution of a chemical and/or physical method for the destruction of the warp threads or weft threads of the third subset of the totality of all warp threads and weft threads;

separation of the warp threads and/or weft threads of the second subset of the totality of all warp threads and weft threads, from the warp threads and/or weft threads of the first subset of the totality of all warp threads and weft threads.

A further development of this method additionally comprises the step that the warp threads and/or weft threads of the second subset after the separation are disposed of or utilised separately from the warp threads and/or weft threads of the first subset.

Further details of the invention and in particular exemplary embodiments of the apparatus according to the invention and the method according to the invention are explained hereinafter with reference to the appended drawings. In the figures:

FIG. 1 shows a perspective view of a textile substrate 1 according to the invention in the form of a woven fabric which in the present example extends parallel to a plane. The textile substrate 1 in this case forms a flat layer having the thickness d and has a first surface O1 and a second surface O2 opposite the first surface O1.

Figure 1:
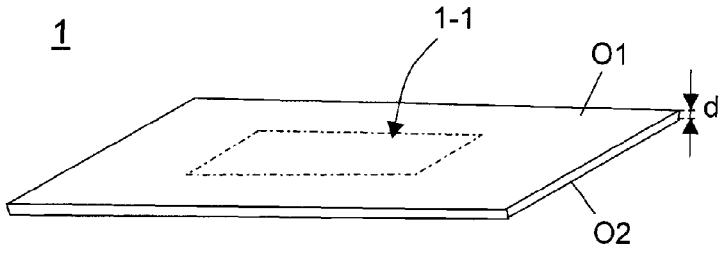
FIG. 1 shows a perspective view of a textile substrate according to the invention in the form of a woven fabric.

FIGS. 3-12 show various embodiments of the textile substrate 1, where these embodiments are subsequently designed with the reference numbers 1A-1G. The specific details shown in FIGS. 3-12 are achieved "in at least one region" of the respective textile substrate 1A-1G. This at least one region is subsequently designated by 1-1. With a view to the invention it should be noted that the region 1-1 can be merely a part of the textile substrate as shown schematically in FIG. 1 for example (the dot-dash line in FIG. 1 marks an outer edge of the region 1-1). In this case the details shown in FIGS. 3-12 need not necessarily be achieved outside the region 1-1. Within the framework of the invention, however, it is also feasible that the region 1-1 is identical to the textile substrate itself. In this case, the details shown in FIGS. 3-12 would be representative for the entire textile substrate.

In the following it is assumed that the textile substrate 1A-1G contains at least two (in the case of the textile substrates 1F and 1G at least three) variously disposable and/or utilisable materials or a plurality of variously disposable and/or utilisable materials selected from at least two (in the case of the textile substrate 1F and 1G from at least three) different utilisation groups. Examples for such materials or utilisation groups can be deduced from Table 1.

In the following it is assumed that the textile substrates 1A-1G are each composed of a warp comprising a plurality of warp threads and a weft comprising a plurality of weft threads, where each warp thread crosses over a plurality of weft threads and each weft thread crosses over a plurality of warp threads so that the warp and the weft jointly form a layer having (the surface O1 and O2). The textile substrates 1A-1G are all executed as "textile substrate according to variant 1" of the invention.

In the following it is further assumed that the entirety of all the warp threads and weft threads of each textile substrate 1A-1G comprises three or more subsets (each containing warp and/or weft threads), which differ in that the warp or weft threads belonging to different subsets consist of different materials. In order to be able to distinguish the individual warp threads and weft threads of the respective textile substrate, the following nomenclature is used to designate the warp threads and weft threads: each warp thread of a textile substrate is subsequently identified with the designation "Ki(j) and each weft thread is identified with the designation "Si(j)". Here "j" is in each case a natural number which characterised the respective subset and therefore the material of the respective warp thread or weft thread. Furthermore "i" is a natural number which serves to characterise warp threads or weft threads which belong to the same subset.

Subsequently Ki(1) or Si(1) designates a warp thread or weft thread which belongs to a first subset of the entirety of all the warp threads and weft threads. This subset comprises warp threads or weft threads where the respective warp thread or weft thread consists of a first one of the variously disposable and/or utilisable materials or from a first one of the disposable and/or utilisable materials selected from the various utilisation groups.

Accordingly Ki(2) or Si(2) designates a warp thread or weft thread which belongs to a second subset of the entirety of all the warp threads and weft threads. This subset comprises warp threads or weft threads where the respective warp thread or weft thread consists of respectively a second one of the variously disposable and/or utilisable materials or from one of a second of the disposable and/or utilisable materials selected from the various utilisation groups.

Ki(3) or Si(3) subsequently designates a warp thread or weft thread which belongs to a third subset of the entirety of all the warp threads and weft threads. This subset comprises warp threads or weft threads which are essential to the invention, which consists of a destructible material and which can be destroyed by means of a suitable chemical and/or physical method.

In connection with textile substrate 1F according to FIG. 11B and textile substrate 1G according to FIG. 12B, Ki(4) or Si(4) subsequently designates a warp thread or weft thread which belongs to a fourth subset of the entirety of all the warp threads and weft threads. This subset comprises warp threads or weft threads where the respective warp thread or weft thread consists of a third one of the variously disposable and/or utilisable materials or from one of a third one of the disposable and/or utilisable materials selected from the various utilisation groups.

Figure 2A:
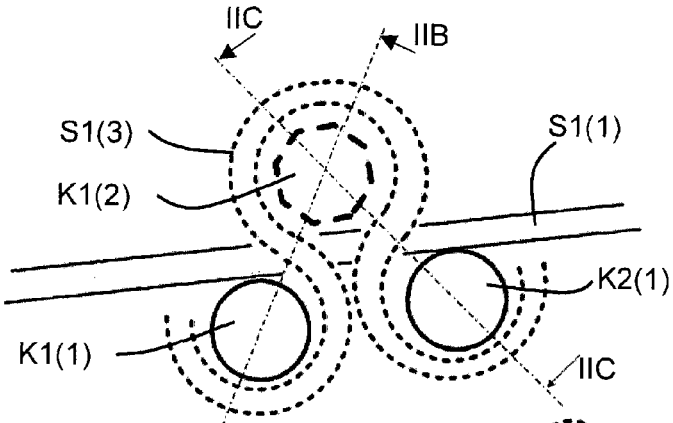
FIG. 2A shows an arrangement of warp and weft threads in a textile substrate according to the invention with a weft thread of the third subset which binds a warp thread of the second subset to warp and weft threads of the first subset.
Figure 2B:
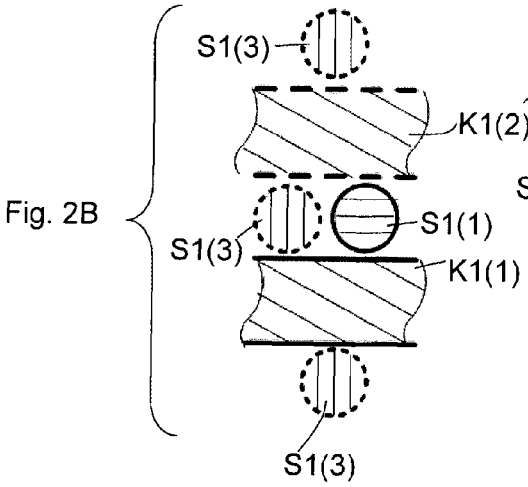
FIG. 2B shows a section through the arrangement according to FIG. 2A along the line IIB-IIB.
Figure 2C:
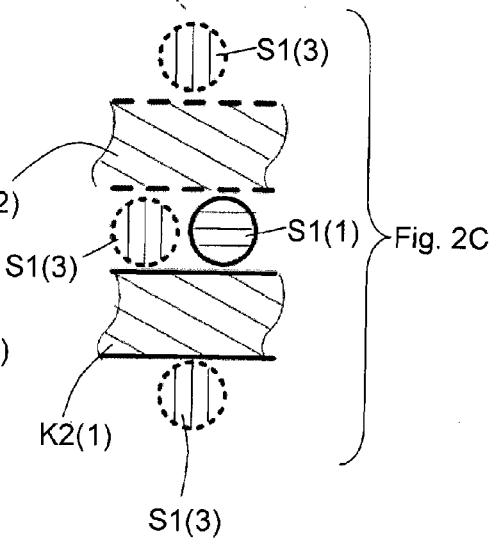
FIG. 2C shows a section through the arrangement according to FIG. 2A along the line IIC-IIC.

FIG. 2A shows as a simple exemplary embodiment of the invention, an arrangement of three warp threads and two weft threads consisting of warp threads K1(1) and K2(1) of the first subset, one weft thread S1(1) of the first subset, one warp thread K1(2) of the second subset and one (destructible) weft thread S1(3) of the third subset. In this arrangement, the respective warp threads K1(1) and K2(1) cross over the weft thread S1(1) on one (same) side, the warp thread K1(2) crosses over the weft thread S(1) on the side opposite the warp threads K1(1) and K2(1). In this example, all the warp threads of the first subset (K1(1) and K2(1)) are separated from the respective warp threads of the second subset (K1(2)) by the weft thread S1(1) of the first subset (as can be seen in particular from FIGS. 2B and 2C). The (destructible) weft thread S1(3) of the third subset is arranged in such a manner that it crosses over the warp threads K1(1) and K2(1) of the first subset on a side facing away from the warp thread K1(2) of the second subset and crosses over the warp thread K1(2) of the second subset on the side facing away from the warp threads K1(1) and K2(1) of the first subset. In this way, the warp thread K1(2) of the second subset is bound to the weft thread S1(1) and the warp threads K1(1) and K2(1) of the first subset. In this situation the warp threads K1(2), K1(1) and K2(1) cannot be separated from one another. If the (destructible) weft thread S1(3) of the third subset according to the invention is destroyed by means of a suitable chemical and/or physical method, the warp thread K1(2) of the second subset is no longer bound to the weft thread S1(1) and the warp threads K1(1) and K2(1) of the first subset. In this situation, the warp thread K1(2) of the second subset is effectively separated from the warp threads K1(1) and K2(1) by the weft thread S1(1) of the first subset, especially as the weft thread S1(1) crosses over the warp threads K1(1), K2(1) and K1(2) at an angle of 90° and is arranged between the warp threads of the first subset (K1(1) and K2(1)) and the warp thread K1(2) of the second subset. On account of this separating effect of the weft thread S1(1), the warp threads of the first subset (K1(1) and K2(1)) can now be separated in a simple manner from the warp thread K1(2) of the second subset.

Figure 3:
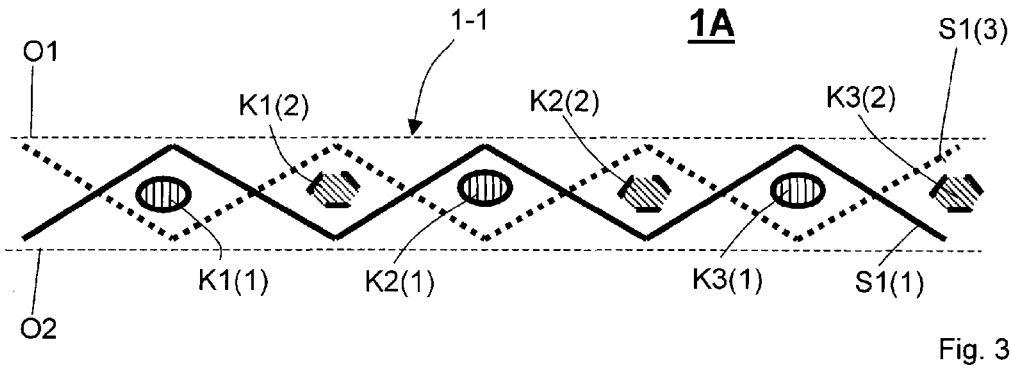
FIG. 3 shows a woven-fabric sectional view of a first embodiment of the textile substrate according to the invention.

FIG. 3 shows a region 1-1 of a textile substrate 1A according to the invention in a woven-fabric sectional view (in a section perpendicular to the respective warp threads). Through the region 1-1 there extends three warp threads K1(1), K2(1), K3(1) of the first subset, at least one weft thread S1(1) of the first subset (and possibly further weft threads of the first subset which extend parallel to the weft thread S1(1) and would have the same profile as the weft threads S1(1) in the diagram according to FIG. 3), three warp threads K1(2), K2(2), K3(2) of the second subset.

and at least one weft thread S1(3) of the third subset (and possibly further weft threads of the third subset which extend parallel to the weft thread S1(3) and would have the same profile as the weft threads S1(3) in the diagram according to FIG. 3).

In the case of the textile substrate 1A, in the region 1-1 each of the warp threads K1(1), K2(1), K3(1) of the first subset crosses over the weft thread S1(1) of the first subset on a side facing the second surface O2. Furthermore, the three warp threads K1(2), K2(2), K3(2) of the second subset cross over the weft thread S1(1) on a side facing the first surface O1. Accordingly in the region 1-1 all the warp threads K1(1), K2(1), K3(1) of the first subset are separated from the warp threads K1(2), K2(2), K3(2) of the second subset by means of the weft thread S1(1) of the first subset. The at least one weft thread S1(3) of the third subset crosses over all the warp threads K1(1), K2(1), K3(1) of the first subset which extend through the region 1-1 on a side facing the second surface O2 and crosses over all the warp threads K1(2), K2(2), K3(2) of the second subset extending through the region 1-1 on a side facing the first surface O1. In this way all the warp threads extending through the region 1-1 are bound by the weft thread S1(1) of the first subset and the weft thread S1(3) of the third subset so that the textile substrate 1A forms a stable layer in the region 1-1. However, if the weft thread S1(3) of the third subset is destroyed according to the invention by means of a suitable chemical and/or physical method, the warp threads K1(1), K2(1), K3(1) of the first subset, warp threads K1(2), K2(2), K3(2) of the second subset and the weft thread S1(1) of the first subset are no longer bound to one another in the region 1-1. As a result of the destruction of the weft thread S1(3) of the third subset, the textile substrate 1A is decomposed into individual warp threads K1(1), K2(1), K3(1), K1(2), K2(2), K3(2) lying loosely next to one another or above one another and the weft thread S1(3).

In this situation, the warp threads K1(2), K2(2), K3(2) of the second subset are effectively separated from the warp threads K1(1), K2(1), K3(1) of the first subset by the weft thread S1(1) of the first subset, especially as the weft thread S1(1) crosses over the warp threads K1(2), K2(2), K3(2), K1(1), K2(1), K3(1) at an angle of 90° and lies between the warp threads of the first subset K1(1), K2(1), K3(1) and the warp threads K1(2), K2(2), K3(2) of the second subset. On account of this separating effect of the weft thread S1(1), the warp threads of the first subset can now be separated in a simple manner from the warp threads of the second subset.

Figure 4:
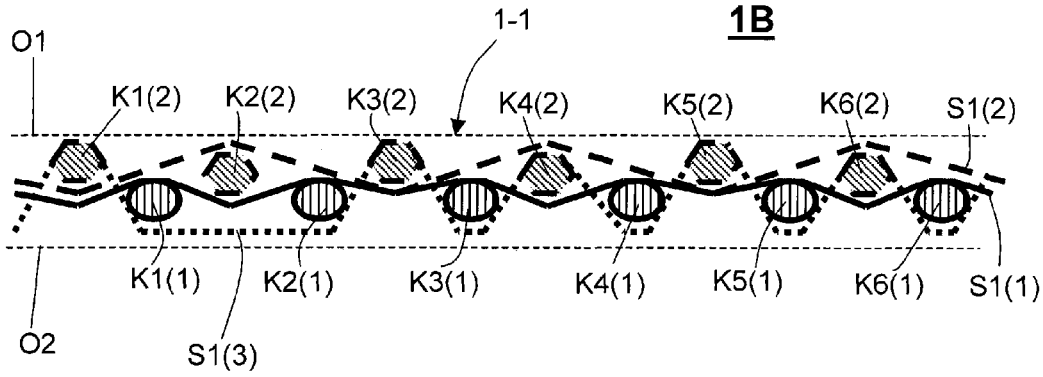
FIG. 4 shows a woven-fabric sectional view of a second embodiment of the textile substrate according to the invention.

FIG. 4 shows a region 1-1 of a textile substrate 1B according to the invention in a woven-fabric sectional view (in a section perpendicular to the respective warp threads). Through the region 1-1 there extends six warp threads K1(1), K2(1), K3(1), K4(1), K5(1), K6(1) of the first subset, at least one weft thread S1(1) of the first subset (and possibly further weft threads of the first subset which extend parallel to the weft thread S1(1) and would have the same profile as the weft threads S1(1) in the diagram according to FIG. 4), six warp threads K1(2), K2(2), K3(2), K4(2), K5(2), K6(2) of the second subset, at least one weft thread S1(2) of the second subset (and possibly further weft threads of the second subset which extend parallel to the weft thread S1(2) and would have the same profile as the weft thread S1(2) in the diagram according to FIG. 4), at least one weft thread S1(3) of the third subset (and possibly further weft threads of the third subset which extend parallel to the weft thread S1(3) and would have the same profile as the weft thread S1(3) in the diagram according to FIG. 4).

In the case of the textile substrate 1B, in the region 1-1 each of the weft thread S1(1) of the first subset crosses over all the warp threads K1(1), K2(1), K3(1), K4(1), K5(1), K6(1) of the first subset extending through the region 1-1 on a side facing the first surface O1 and crosses over all the warp threads K1(2), K2(2), K3(2), K4(2), K5(2), K6(2) of the second subset extending through the region 1-1 on a side facing the second surface O2 and consequently brings about a spatial separation between the warp threads of the first subset and the warp threads of the second subset.

The weft thread S1(2) of the second subset crosses over alternately all the warp threads of the second subset extending through the region 1-1 so that the weft thread S1(2) crosses over the warp threads K2(2), K4(2) and K6(23) on a side facing the first surface O1 and crosses over the warp threads K1(2), K3(2) and K5(2) on a side facing the second surface O2. Furthermore, the weft thread S1(2) of the second subset crosses over the warp threads of the first subset extending through the region 1-1 on a side facing the first surface O1. Consequently the warp threads K1(1), K2(1), K3(1), K4(1), K5(1), K6(1) of the first subset and the warp threads K1(2), K2(2), K3(2), K4(2), K5(2), K6(2) of the second subset are not bound to one another by the weft threads S1(1) and S1(2) of the first and second subset.

In the example, the weft thread S1(3) of the third subset extends through the region 1-1 in such a manner that it crosses over all the warp threads of the first subset extending through the region 1-1 on a side facing the second surface O2 and additionally crosses over the warp threads K1(2), K3(2), K4(2), K5(2), K6(2) of the second subset on a side facing the first surface O1. The warp thread K2(2) on the other hand is crossed over by the weft thread S1(3) on a side facing the second surface O2. This arrangement of the weft thread S1(3) of the third subset has the effect in the present case that the warp threads and weft threads of the first and second subset extending through the region 1-1 are bound to one another in the region 1-1 and form a stable layer as long as the weft thread S1(3) is not destroyed.

Figure 8:
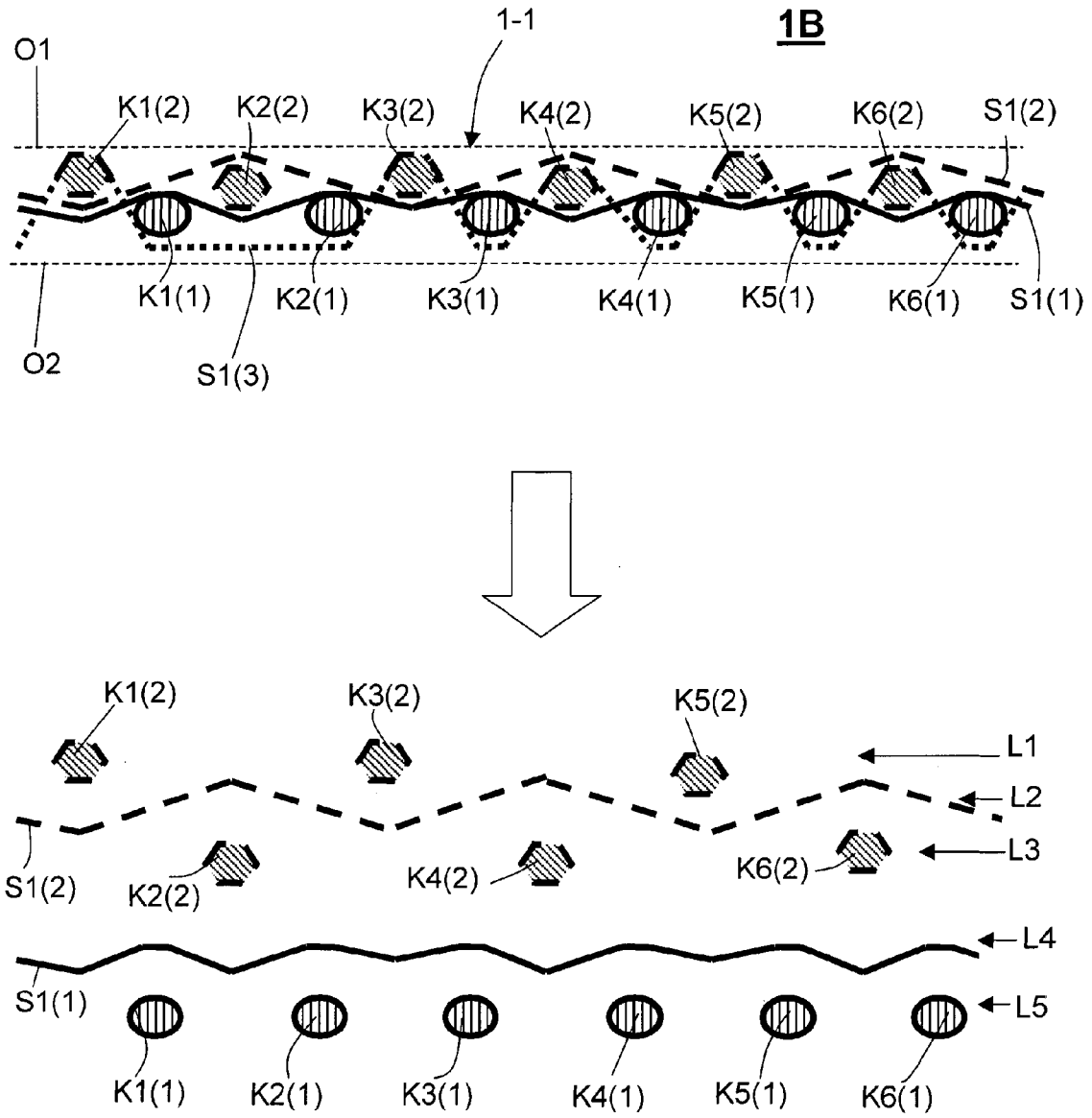
FIG. 8 shows two sectional views of the second embodiment according to FIG. 4 before (upper figure) and after (lower figure) destruction of weft threads of the third subset.

If in the case of textile substrate B, the weft thread S1(3) of the third subset is destroyed according to the invention by applying a suitable chemical and/or physical method, the warp threads and weft threads of the first subset can then be separated in a simple manner from the warp threads and weft threads of the second subset. This is particularly apparent from FIG. 8. The upper part of FIG. 8 shows the textile substrate in a state in which the weft thread S1(3) of the third subset is intact (according to the woven-fabric sectional view according to FIG. 4). The lower part of FIG. 8 shows the relative arrangement of the warp threads and weft threads of the first and second subset extending through the region 1-1 for the case that the weft thread S1(3) in the textile substrate 1B is destroyed and is completely removed (in a sectional view similar to the woven-fabric sectional view according to FIG. 4). As can be seen, after destruction of the warp thread S1(3) the warp threads and weft threads of the first and second subset extending through the region 1-1 are arranged in a plurality of layers L1-L5 which follow one another spatially and which are separated from one another. Here the warp threads K1(2), K3(2) and K5(2) of the second subset form the first layer L1, the weft thread S1(2) of the second subset forms a second layer L2, the warp threads K2(2), K4(2) and K6(2) of the second subset form a third layer L3, the weft thread S1(1) of the first subset forms a fourth layer L4, the warp threads K1(1), K2(1), K3(1), K4(1), K5(1), K6(1) of the first subset form a fifth layer L5. As can be seen, the warp threads pertaining to the layer L1 are spatially separated from the warp threads L3 pertaining to the layer L3 by the weft thread S1(2) pertaining to the layer L2. In this case, the weft thread S1(2) crosses the warp threads pertaining to the layer L1 and the warp threads L3 pertaining to the layer L3 in each case at an angle of 90° but does not bind these warp threads to one another. Furthermore, the warp threads pertaining to the layer L3 are spatially separated from the warp threads pertaining to the layer L5 by the weft thread S1(1) pertaining to the layer L4. In this case, the weft thread S1(1) crosses the warp threads pertaining to the layer L3 and the warp threads L3 pertaining to the layer L5 in each case at an angle of 90° but does not bind these warp threads to one another. Accordingly, the warp threads or weft threads pertaining to the respective layers L1-L5 form an arrangement of crossing threads which lie individually loosely above one another or next to one another and can be individually separated from one another. In this case, it is helpful that the warp threads or weft threads of neighbouring layers each cross at an angle of 90°. Thus, the warp threads and weft threads can preferably be separated in layers (in the sequence of layers L1-L5 successively).

Figure 5:
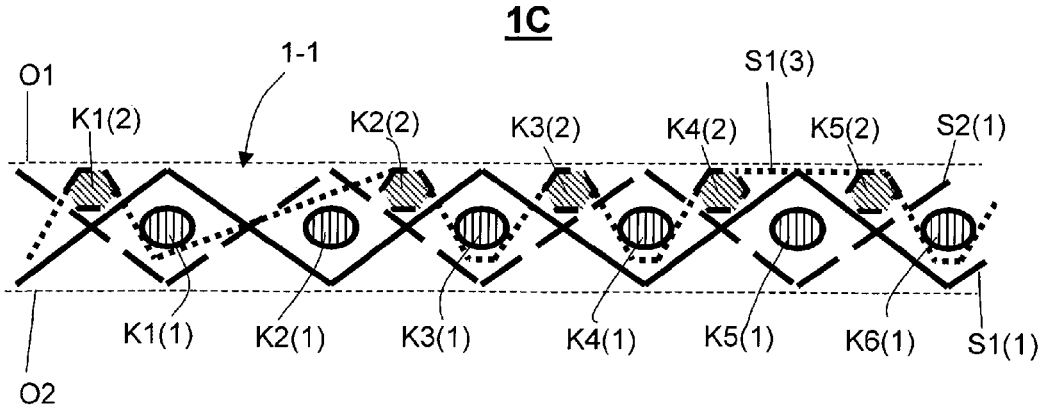
FIG. 5 shows a woven-fabric sectional view of a third embodiment of the textile substrate according to the invention.

FIG. 5 shows a region 1-1 of a textile substrate 1C according to the invention in a woven-fabric sectional view (in a section perpendicular to the respective warp threads). Through the region 1-1 there extends

- six warp threads K1 (1), K2 (1), K3 (1), K4(1), K5(1), K6(1) of the first subset,
- at least two weft threads S1(1) and S2(1) of the first subset (and possibly further weft threads of the first subset which extend parallel to one of the weft threads S1(1) or S2(1) and would have the same profile as the respective weft thread S1(1) or S2(1) in the diagram according to FIG. 5),
- five warp threads K1(2), K2(2), K3(2), K4(2), K5(2), of the second subset,
- at least one weft thread S1(3) of the third subset (and possibly further weft threads of the third subset which extend parallel to the weft thread S1(3) and would have the same profile as the weft thread S1(3) in the diagram according to FIG. 5).

In the case of the textile substrate 1C, in the region 1-1 the weft thread S1(1) crosses over the warp threads K1(1), K3(1), K5(1) of the first subset on a side facing the first surface O1 and crosses over the warp threads K2(1), K4(1), K6(1) of the first subset on a side facing the second surface O2. On the other hand, the weft thread S2(1) crosses over the warp threads K1(1), K3(1), K5(1) of the first subset on a side facing the second surface O2 and crosses over the warp threads K2(1), K4(1), K6(1) of the first subset on a side facing the first surface O1. Consequently, each of the warp threads of the first subset extending through the region 1-1 is embraced in opposite directions by the two weft threads S1(1) and S2(1) on opposite (facing the first surface O1 or the second surface O2) sides. Consequently, the warp threads and weft threads of the first subset extending through the region 1-1 are bound to one another and form a stable flatly configured unit which is integrated as a whole in the textile substrate 1C.

The warp threads K1(2), K2(2), K3(2), K4(2), K5(2) of the second subset each cross over the weft threads S1(1) and S2(1) of the first subset on a side facing the first surface O1. Consequently the warp threads K1(1), K2(1), K3(1), K4(1), K5(1), K6(1) of the first subset and the warp threads K1(2), K2(2), K3(2), K4(2), K5(2), of the second subset are not bound to one another by the weft threads S1(1) and S1(2) of the first and second subset.

In the present example all the warp threads of the second subset extending through the region 1-1 are bound by means of the weft thread S1(3) of the third subset to the warp threads and weft threads of the first subset. For this purpose the weft thread S1(3) is arranged in such a manner that it crosses over all the warp threads of the second subset extending through the region 1-1 on a side facing the first surface O1 and a plurality of the warp threads of the first subset extending through the region 1-1 on a side facing the second surface O2. As can be seen from FIG. 5, however it is not necessary that the weft thread S1(3) crosses over all the warp threads of the first subset extending through the region 1-1 on a side facing the second surface O2 (in the case of the textile substrate 1C the weft thread S1(3) crosses over the warp threads K2(1) and K5(1) on a side facing the first surface O1. The warp threads and weft threads of the first and second subset extending through the region 1-1 are nevertheless bound by means of the weft thread S1(3) of the third subset to form a stable layer, especially as the warp threads and weft threads of the first subset (as already mentioned) cross over one another in such a manner that they are bound to one another and form a stable flatly configured unit.

Figure 9:
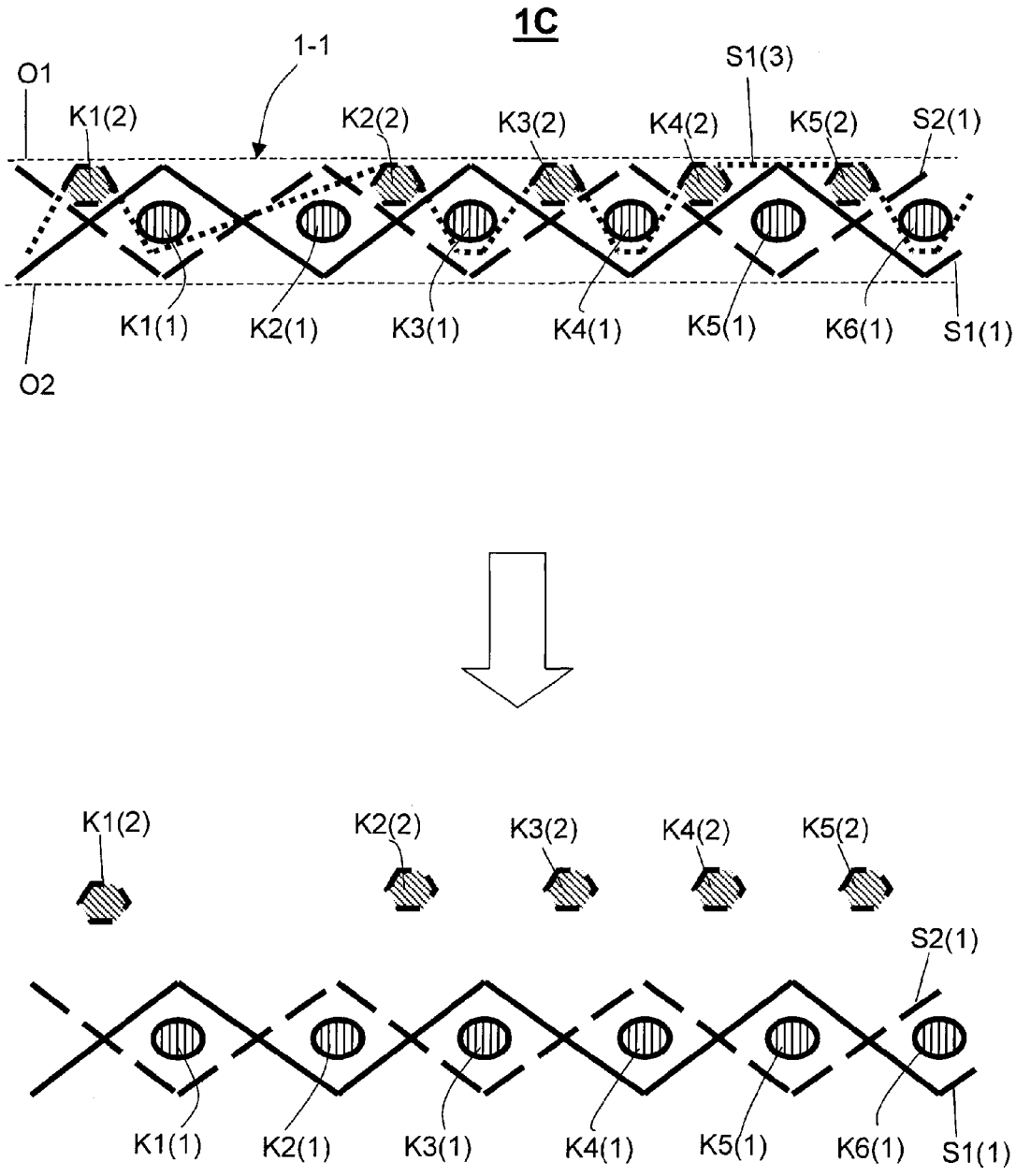
FIG. 9 shows two sectional views of the third embodiment according to FIG. 5 before (upper figure) and after (lower figure) destruction of weft threads of the third subset.

If in the case of the textile substrate 1C the weft thread S1(3) of the third subset is destroyed according to the invention by using a suitable chemical and/or physical method, the warp threads and weft threads of the first subset can be separated in a simple manner from the warp threads and weft threads of the second subset. This is particularly apparent from FIG. 9. In the upper part of FIG. 9 the textile substrate 1C is shown in a state in which the weft thread S1(3) of the third subset is intact (according to the woven fabric section view according to FIG. 5). The lower part of FIG. 9 shows the relative arrangement of the warp threads and weft threads of the first and second subset extending through the region 1-1 for the case that the weft thread S1(3) in the textile substrate 1C is destroyed and completely removed (in a sectional view similar to the woven-fabric sectional view according to FIG. 5). As can be seen from FIG. 9, after destruction of the weft thread S1(3) of the third subset, the region 1-1 of the textile substrate 1C is decomposed into a stable flatly configured unit formed by the warp threads K1(1), K2(1), K3(1), K4(1), K5(1), K6(1) and weft threads S1(1) and S2(1) of the first subset bound to one another and a plurality of warp threads of the second subset. After destruction of the weft thread S1(3) of the third subset, the warp threads K1 (2), K2 (2), K3 (2), K4 (2), K5 (2) of the second subset are present as single loose warp threads which can be separated individually from the warp threads and weft threads of the first subset.

Figure 6:
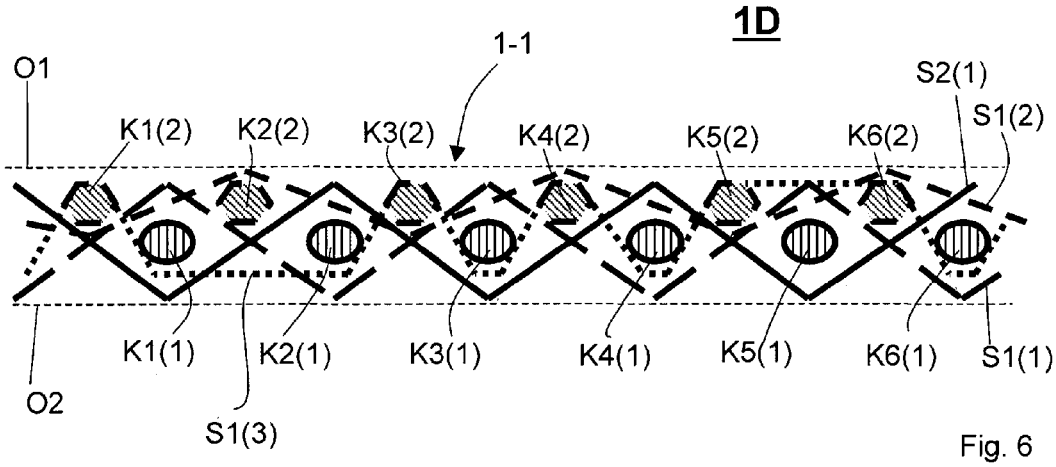
FIG. 6 shows a woven-fabric sectional view of a fourth embodiment of the textile substrate according to the invention.

FIG. 6 shows a region 1-1 of a textile substrate 1D according to the invention in a woven-fabric sectional view (in a section perpendicular to the respective warp threads). Through the region 1-1 there extends

- six warp threads K1(1), K2(1), K3(1), K4(1), K5(1), K6(1) of the first subset, at least two weft threads S1(1) and S2(1) of the first subset (and possibly further weft threads of the first subset which extend parallel to the weft threads S1(1) or S2(1) and would have the same profile as the respective weft threads S1(1) or S2(1) in the diagram according to FIG. 6), six warp threads K1 (2), K2 (2), K3 (2), K4(2), K5(2), K6(2) of the second subset, at least one weft thread S1(2) of the second subset (and possibly further weft threads of the second subset which extend parallel to the weft thread S1(2) and would have the same profile as the weft thread S1(2) in the diagram according to FIG. 6), and at least one weft thread S1(3) of the third subset (and possibly further weft threads of the third subset which extend parallel to the weft thread S1(3) and would have the same profile as the weft thread S1(3) in the diagram according to FIG. 6).

In the case of the textile substrate 1D, the arrangement of the warp threads K1(1), K2(1), K3(1), K4(1), K5(1), K6(1) of the first subset and weft threads S1(1), S2(1) of the first subset extending through the region 1-1 is identical to the arrangement of the corresponding warp threads and weft threads of the first subset which is found in the case of the textile substrate 1C (FIG. 5). Consequently, also in the case of the textile substrate 1D the warp threads K1(1), K2(1), K3(1), K4(1), K5(1), K6(1) of the first subset and weft threads S1(1), S2(1) of the first subset extending through the region 1-1 are bound to one another and form a stable flatly configured unit which is integrated as a whole in the textile substrate 1D.

In the case of the case of the textile substrate 1D, the arrangement of the warp threads K1(2), K2(2), K3(2), K4(2), K5(2), K6(2) and the weft thread S1(2) of the second subset is identical to the arrangement of the corresponding warp threads and weft threads of the second subset which is present in the case of the textile substrate 1B (FIG. 4).

In the case of the textile substrate 1D the weft threads S1(1) and S2(1) of the first subset cross over all the warp threads K1 (2), K2 (2), K3 (2), K4 (2), K5(2), K6(2) of the second subset extending through the region 1-1 on a side facing the second surface O2 so that the weft threads S1(1) and S2(1) consequently bring about a spatial separation between the warp threads of the first subset and the warp threads of the second subset and the warp threads of the first subset extending through the region 1-1 are not bound by means of the weft threads S1(1) and S2(1) to the warp threads of the second subset extending through the region 1-1.

The weft thread S1(2) of the second subset crosses over alternately all the warp threads of the second subset extending through the region 1-1 so that the weft thread S1(2) crosses over the warp threads K2(2), K4(2) and K6(2) on a side facing the first surface O1 and crosses over K1(2), K3(2) and K5(2) on a side facing the second surface O2. Furthermore the weft threads S1(2) of the second subset crosses over the warp threads of the first subset extending through the region 1-1 on a side facing the first surface O1. Consequently the warp threads warp threads K1(1), K2(1), K3(1), K4(1), K5(1), K6(1) of the first subset and the warp threads K1(2), K2(2), K3(2), K4(2), K5(2), K6(2) of the second subset are not bound to one another by the weft threads S1(1), S2(1) and S1(2) of the first and second subset.

In the present example the weft thread S1(3) of the third subset extends through the region 1-1 in such a manner that it crosses over the warp threads K1(1), K2(1), K3(1), K4(1), K6(1) of the first subset on a side facing the second surface O2 and then crosses over the warp threads K1(2), K3(2), K4(2), K5(2), K6(2) of the second subset on a side facing the first surface O1. In this way all the warp threads and weft threads of the first and second subset extending through the region 1-1 are connected to one another by means of the weft thread S1(3) of the third subset in the region 1-1 to form a stable layer as long as the weft thread S1(3) is not destroyed.

As can be seen from FIG. 6, however it is not necessary that the weft thread S1(3) crosses over all the warp threads of the first subset extending through the region 1-1 on a side facing the second surface O2 and all the warp threads of the second subset extending through the region 1-1 on a side facing the first surface O1 in order to connect the warp threads and weft threads stably to one another (in the case of the textile substrate 1D, the weft thread S1(3) crosses over the warp thread K5(1) of the first subset on a side facing the first surface O1 and crosses over the warp thread K2(2) of the second subset on a side facing the second surface O2). The warp threads and weft threads of the first and second subset extending through the region 1-1 are nevertheless bound by means of the weft thread S1(3) of the third subset to form a stable layer, especially as the warp threads and weft threads of the first subset (as already mentioned) cross over one another in such a manner that they are bound to one another and form a stable flatly configured unit and the warp thread K2(2) of the second subset is bound by means of the weft thread S1(2) to the warp threads and weft threads of the first subset as long as the weft thread S1(3) is not destroyed.

If in the case of the textile substrate 1D the weft thread S1(3) of the third subset is destroyed according to the invention by using a suitable chemical and/or physical method, the warp threads and weft threads of the first subset can be separated in a simple manner from the warp threads and weft threads of the second subset. After destruction of the weft thread S1(3) of the third subset, the region 1-1 of the textile substrate 1D is decomposed into a stable flatly configured unit formed by the warp threads K1(1), K2(1), K3(1), K4(1), K5(1), K6(1) and weft threads S1(1) and S2(1) of the first subset bound to one another (similar to the arrangement of the warp threads K1(1), K2(1), K3(1), K4(1), K5(1), K6(1) and weft threads S1(1) and S2(1) of the first subset in the case of the textile substrate 1C, as shown in FIG. 9) and a plurality of warp threads of the second subset and the weft threads S1(2) of the second subset (similar to the arrangement of the warp threads K1(2), K2(2), K3(2), K4(2), K5(2), K6(2) and the weft thread S1(2) of the second subset in the case of textile substrate 1B, as shown in FIG. 8). After destruction of the weft thread S1(3) of the third subset, the warp threads K1(2), K2(2), K3(2), K4(2), K5(2), K6(2) and the weft thread S1(2) of the second subset are present as single loose threads which can be separated individually from the warp threads and weft threads of the first subset.

Figure 7:
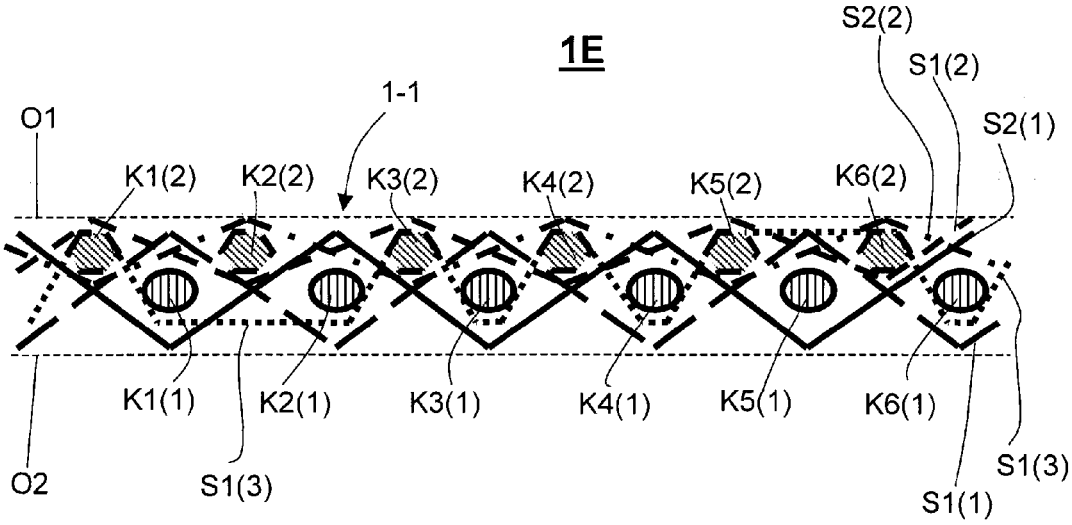
FIG. 7 shows a woven-fabric sectional view of a fifth embodiment of the textile substrate according to the invention.

FIG. 7 shows a region 1-1 of a textile substrate 1E according to the invention in a woven-fabric sectional view (in a section perpendicular to the respective warp threads). Through the region 1-1 there extends six warp threads K1(1), K2(1), K3(1), K4(1), K5(1), K6(1) of the first subset, at least two weft threads S1(1) and S2(1) of the first subset (and possibly further weft threads of the first subset which extend parallel to the weft threads S1(1) or S2(1) and would have the same profile as the weft threads S1(1) or S2(1) in the diagram according to FIG. 7), six warp threads K1 (2), K2 (2), K3 (2), K4(2), K5(2), K6(2) of the second subset, at least two weft threads S1(2) and S2(2) of the second subset (and possibly further weft threads of the second subset which extend parallel to the weft threads S1(2) or S2(2) and would have the same profile as the respective weft thread S1(2) or S2(2) in the diagram according to FIG. 7), and at least one weft thread S1(3) of the third subset (and possibly further weft threads of the third subset which extend parallel to the weft thread S1(3) and would have the same profile as the weft thread S1(3) in the diagram according to FIG. 7).

In the case of the textile substrate 1E, the arrangement of the warp threads K1(1), K2(1), K3(1), K4(1), K5(1), K6(1) and weft threads S1(1), S2(1) of the first subset is identical to the arrangement of the corresponding warp threads and weft threads of the first subset which exists in the case of the textile substrate 1C (FIG. 5). Consequently, in the case of the textile substrate 1E, the warp threads K1(1), K2(1), K3(1), K4(1), K5(1), K6(1) and weft threads S1(1), S2(1) of the first subset extending through the region 1-1 are bound to one another and form a stable, flatly configured unit which is integrated as a whole in the textile substrate 1E.

In the case of the textile substrate 1E, the weft thread S1(2) crosses over the warp threads K1(2), K3(2) and K5(2) of the second subset on a side facing the first surface O1 and crosses over the warp threads K2(2), K4(2) and K6(2) of the second subset on a side facing the second surface O2. On the other hand, the weft thread S2(2) crosses over the warp threads K1(2), K3(2), K5(2) of the second subset on a side facing the second surface O2 and crosses over the warp threads K2(2), K4(20, K6(2) of the second subset on a side facing the first surface O1. Consequently the warp threads of the second subset extending through the region 1-1 are embraced in opposite directions by the two weft threads S1(2) and S2(2) on opposite sides (facing the first surface O1 or the second surface O2). Consequently the warp threads and weft threads of the second subset extending through the region 1-1 are bound to one another and form a stable, flatly configured unit which is integrated as a whole in the textile substrate 1E.

In the case of the textile substrate 1E, the weft threads S1(1) and S2(1) of the first subset cross over the warp threads of the second subset extending through the region 1-1 on a side facing the second surface O2 and the weft threads S1(2) and S2(2) of the second subset cross over the warp threads of the first subset extending through the region 1-1 on a side facing the first surface O1. Accordingly, the warp threads of the first subset extending through the region 1-1 are separated from the warp threads of the second subset extending through the region 1-1 by the weft threads S1(1) and S2(1) of the first subset or the weft threads S1(2) and S2(2) of the second subset and consequently are not bound to the warp threads of the second subset extending through the region 1-1.

In the present example the weft thread S1(3) of the third subset extends through the region 1-1 in such a manner that it crosses over the warp threads K1(1), K2(1), K3(1), K4(1), K6(1) of the first subset on a side facing the second surface O2 and crosses over the warp threads K1(2), K3(2), K4(2), K5(2), K6(2) of the second subset on a side facing the first surface O1. In this way all the warp threads and weft threads of the first and second subset extending through then region 1-1 are connected to one another by means of the weft thread S1(3) of the third subset in the region 1-1 to form a stable layer as long as the weft thread S1(3) is not destroyed.

If in the case of the textile substrate 1E the weft thread S1(3) of the third subset is destroyed according to the invention by using a suitable chemical and/or physical method, the warp threads and weft threads of the first subset can be separated in a simple manner from the warp threads and weft threads of the second subset. This is particularly apparent from FIG. 10. In the upper part of FIG. 10 the textile substrate 1E is shown in a state in which the weft thread S1(3) of the third subset is intact (according to the woven fabric section view according to FIG. 7). The lower part of FIG. 10 shows the relative arrangement of the warp threads and weft threads of the first and second subset extending through the region 1-1 for the case that the weft thread S1(3) in the textile substrate 1E is destroyed and completely removed (in a sectional view similar to the woven-fabric sectional view according to FIG. 7).

Figure 10:
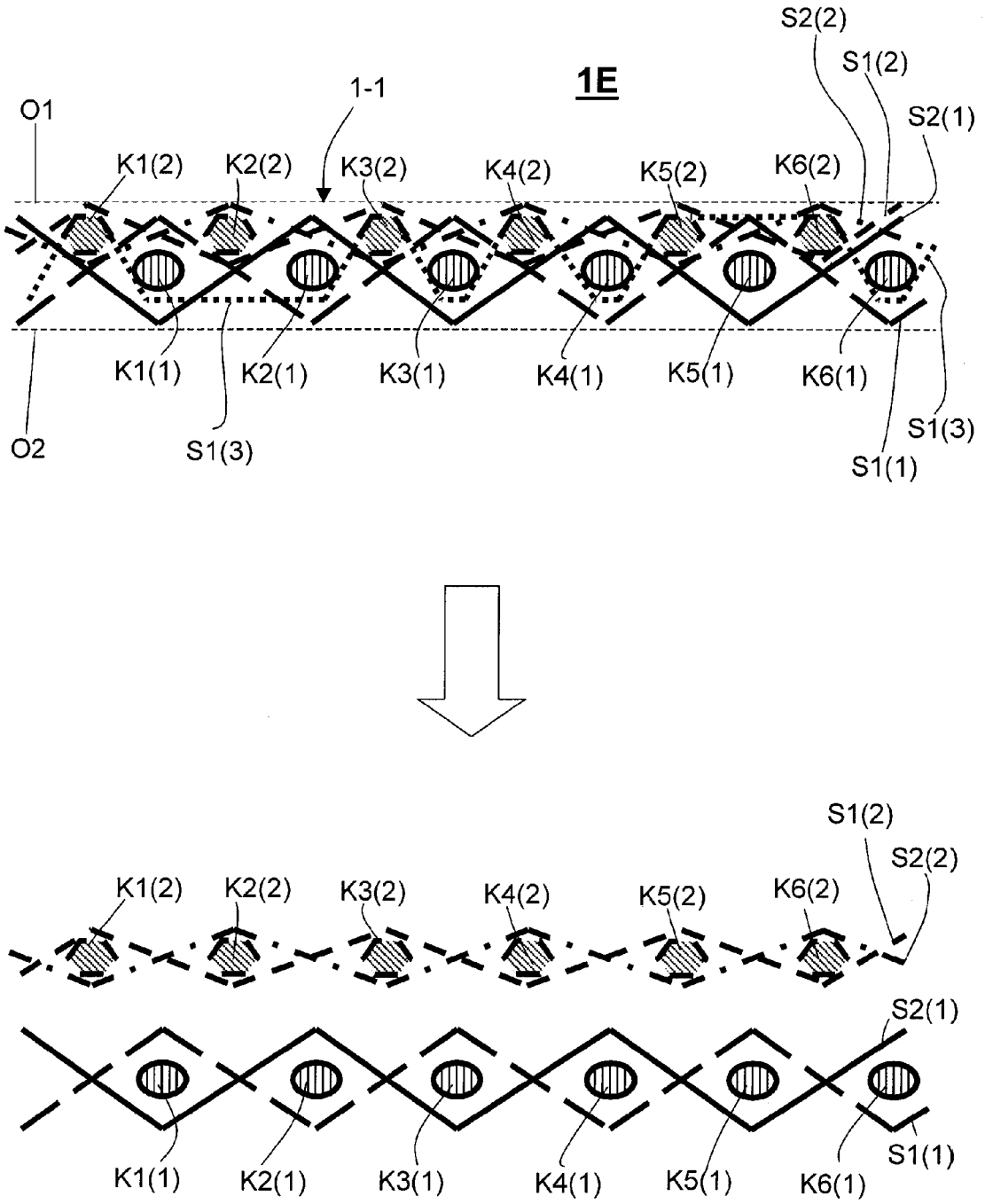
FIG. 10 shows two sectional views of the fifth embodiment according to FIG. 7 before (upper figure) and after (lower figure) destruction of weft threads of the third subset.

As can be seen from FIG. 10, after destruction of the weft thread S1(3) of the third subset, the region 1-1 of the textile substrate 1E is decomposed into two stable flatly configured units: a first unit formed by the warp threads K1(1), K2(1), K3(1), K4(1), K5(1), K6(1) and weft threads S1(1) and S2(1) of the first subset bound to one another and a second unit formed by the warp threads K1(2), K2(2), K3(2), K4(2), K5(2), K6(2) and weft threads S1(2) and S2(2) of the second subset bound to one another. These two units can then be separated from one another.

Although the textile substrate 1A-1E according to FIGS. 3-10 merely comprises two variously disposable and/or utilisable materials or a plurality of disposable and/or utilisable materials selected from merely two different utilisation groups, the invention also makes it possible to specify textile substrates which comprise three or more variously disposable and/or utilisable materials or a plurality of disposable and/or utilisable materials selected from three or more different utilisation groups and allows a separation of the various materials. This will be explained in the following with reference to two examples shown in FIGS. 11A-12C.

Figure 11A:
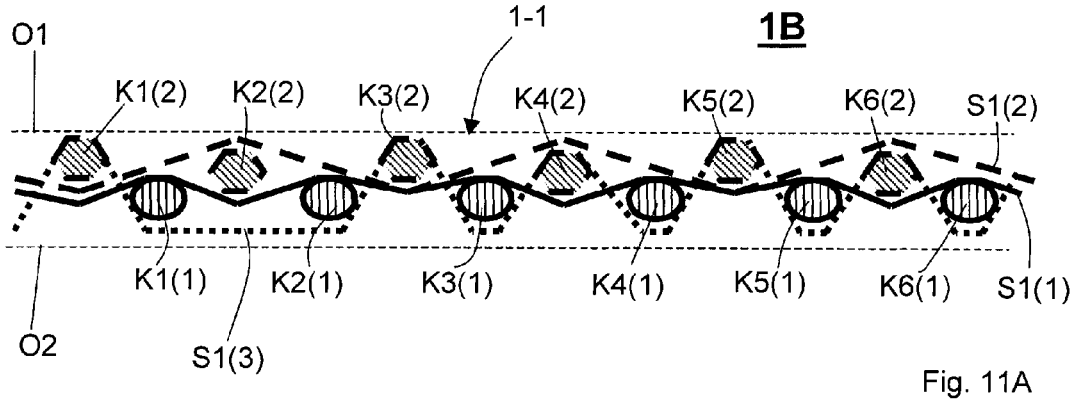
FIG. 11A shows a woven-fabric sectional view of the second embodiment as in FIG. 4.
Figure 11B:
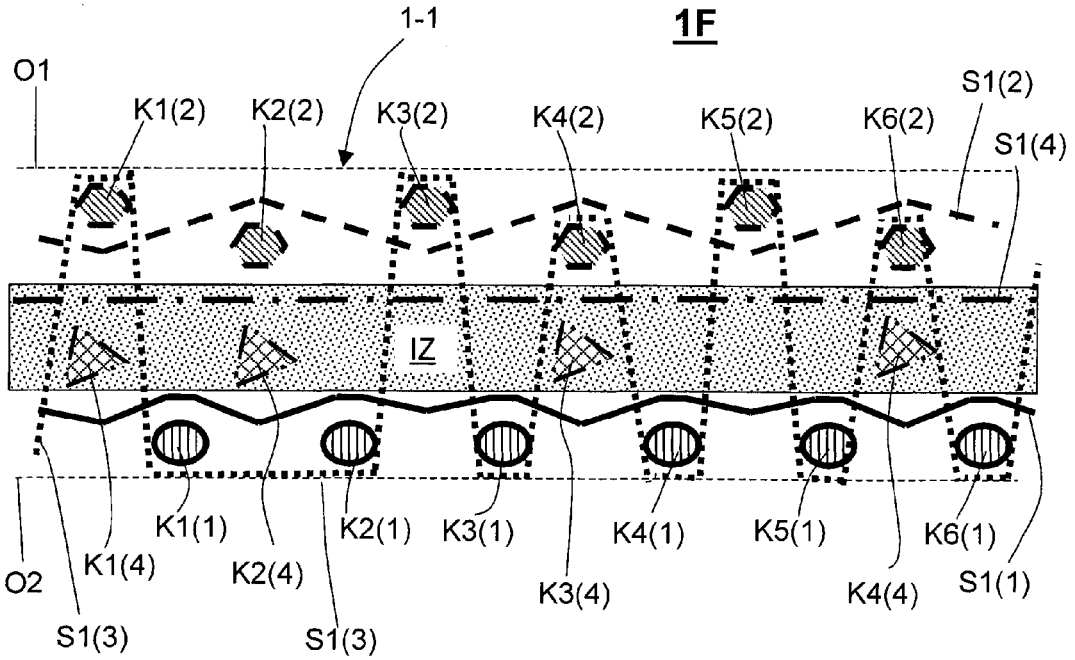
FIG. 11B shows a woven fabric sectional view of a sixth embodiment of the textile substrate according to the invention which is based on a further development of the embodiment according to FIG. 11A.

FIG. 11B shows a region 1-1 of a textile substrate 1F according to the invention in a woven-fabric sectional view (in a section perpendicular to the respective warp threads). The textile substrate 1F can be seen as a further development of the textile substrate 1B according to FIG. 4. In order to facilitate a comparison, FIG. 11A contains a woven-fabric section view of the textile substrate 1B (identical to the view in FIG. 4). The textile substrate 1F is similar to the textile substrate 1B in regard to its structure insofar as it comprises—like the textile substrate B:

six warp threads K1(1), K2(1), K3(1), K4(1), K5(1), K6(1) of the first subset, at least one weft thread S1(1) of the first subset (and possibly further weft threads of the first subset which extend parallel to the weft thread S1(1) and would have the same profile as the weft threads S1(1) in the diagram according to FIG. 11), six warp threads K1 (2), K2 (2), K3 (2), K4(2), K5(2), K6(2) of the second subset, at least one weft thread S1(2) of the second subset (and possibly further weft threads of the second subset which extend parallel to the weft thread S1(2) and would have the same profile as the weft thread S1(2) in the diagram according to FIG. 11B), at least one weft thread S1(3) of the third subset (and possibly further weft threads of the third subset which extend parallel to the weft thread S1(3) and would have the same profile as the weft thread S1(3) in the diagram according to FIG. 11B).

In the case of the textile substrate 1F, the arrangement of the warp threads K1(1), K2(1), K3(1), K4(1), K5(1), K6(1) and the weft thread S1(1) of the first subset extending through the region 1-1 and of the warp threads K1 (2), K2 (2), K3 (2), K4 (2), K5(2), K6(2) and the weft thread S1(2) of the second subset extending through the region 1-1 relative to one another is identical to the arrangement of the corresponding warp threads and weft threads of the first subset and the second subset which exists in the case of the textile subset 1B (FIG. 11A).

Unlike the textile substrate 1B, the textile substrate 1F comprises three warp threads K1(4), K2(4), K3(4) of the fourth subset and at least one weft thread S1(4) of the fourth subset (and optionally further weft threads of the fourth subset which extend parallel to the weft thread S1(4)). In the case of the textile substrate 1F, the respective warp threads and weft threads of the fourth subset are arranged in an inner zone IZ (shown as a dotted area in FIG. 11B) which extends between the respective warp threads and weft threads of the first subset and the respective warp threads and weft threads of the second subset. In the present example, the warp threads K1(4), K2(4), K3(4) and the weft thread S1(4) of the fourth subset extend in such a manner in the inner zone IZ that the warp threads K1(4), K2(4), K3(4) of the fourth subset cross over the weft thread S1(1) of the first subset on a side facing the first surface O1, the weft thread S1(4) of the fourth subset on a side facing the second surface O2 and the weft thread S1(2) of the second subset on a side facing the second surface O2. Furthermore, the weft thread S1(4) of the fourth subset crosses over the warp threads of the second subset extending through the region 1-1 on a side facing the second surface O2.

The arrangement of the warp threads K1(4), K2(4), K3(4) and the weft thread S1(4) in the inner zone ensures that the warp threads of the first, second and fourth subset extending through the region 1-1 are not bound to one another by the weft threads S1(1), S1 (2) and S1(4).

In the case of the textile substrate 1F, the weft thread S1(3) of the third subset extends through the region 1-1 in such a manner that it crosses over all the warp threads of the first subset extending through the region 1-1 on a side facing the second surface O2 and additionally crosses over the warp threads K1(2), K3(2), K4(2), K5(2), K6(2) of the second subset on a side facing the first surface O1. In this way, all the warp threads and weft threads of the first, second and fourth subset extending through the region 1-1 are connected to one another by means of the weft thread S1(3) of the third subset in the region 1-1 to form a stable layer as long as the weft thread S1(3) is not destroyed.

If, in the case of textile substrate 1F the weft thread S1(3) of the third subset is destroyed according to the invention by application of a suitable chemical and/or physical method, the textile substrate is then decomposed into an arrangement of crossing-over threads which lie loosely next to one another or above one another and which can be separated individually from one another. As can be seen from FIG. 11B, the warp threads of the second and fourth subset are separated by the weft thread S1(4) of the fourth subset and the warp threads of the first and fourth subset are separated by the weft threads S1(1) of the first subset. After destruction of the weft thread S1(3) of the third subset it is thereby possible to separate the respective warp threads and weft threads of the first, second and fourth subset in layers.

Figure 12A:
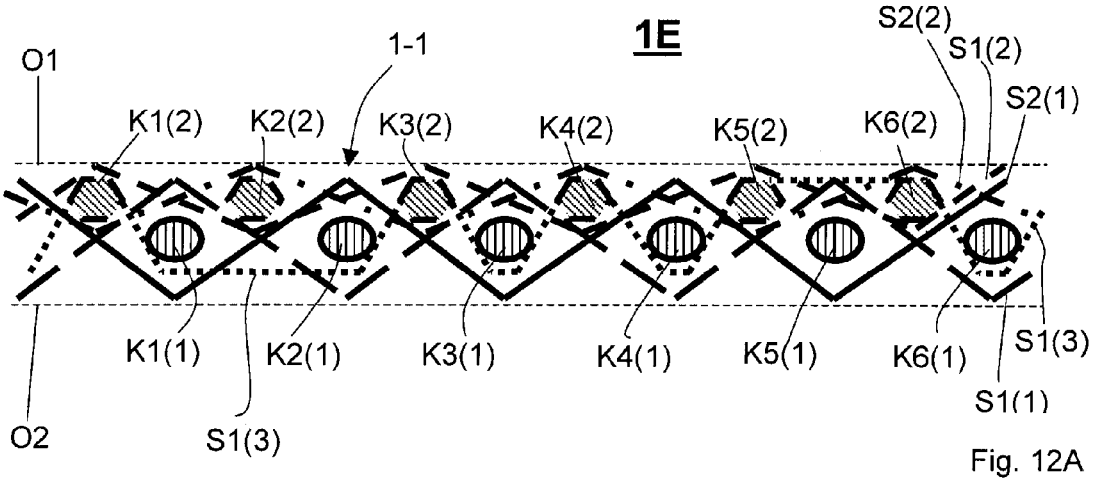
FIG. 12A shows a woven-fabric sectional view of the fifth embodiment as in FIG. 7.
Figure 12B:
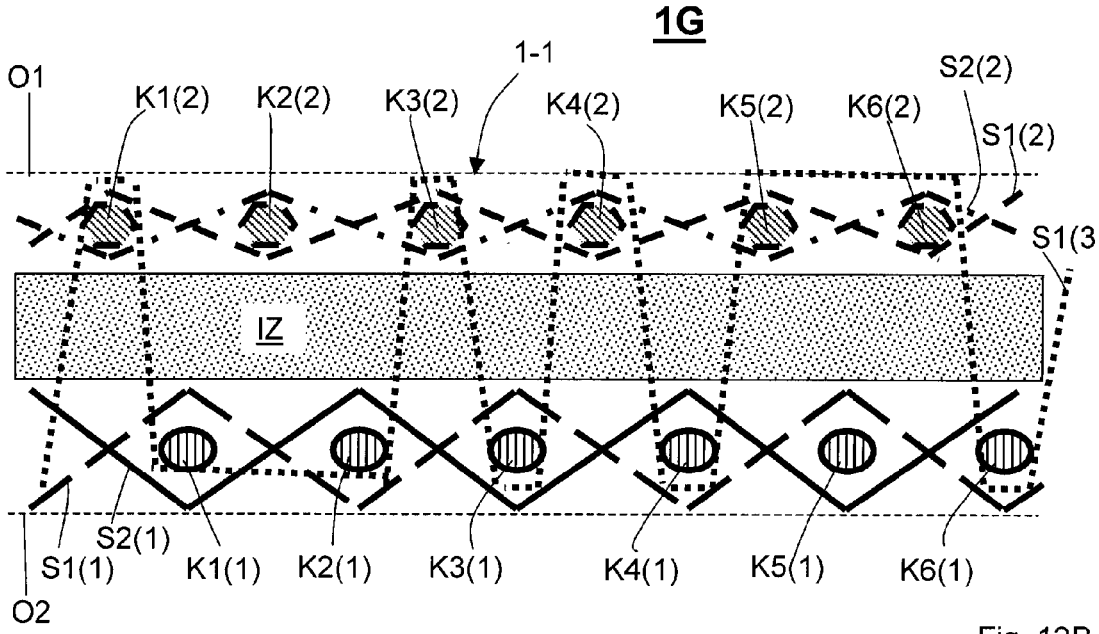
FIG. 12B shows a woven fabric sectional view of a seventh embodiment of the textile substrate according to the invention which is based on a further development of the embodiment according to FIG. 11A.

FIG. 12B shows a region 1-1 of a textile substrate 1G according to the invention in a woven-fabric sectional view (in a section perpendicular to the respective warp threads). The textile substrate 1G can be seen as a further development of the textile substrate 1E according to FIG. 7. In order to facilitate a comparison, FIG. 12A contains a woven-fabric sectional view of the textile substrate 1E (identical to the view in FIG. 7). The textile substrate 1F is similar to the textile substrate 1B in regard to its structure insofar as it comprises:

- six warp threads K1(1), K2(1), K3(1), K4(1), K5(1), K6(1) of the first subset,
- at least two weft threads S1(1) and S(2)1 of the first subset,
- six warp threads K1 (2), K2 (2), K3 (2), K4(2), K5(2), K6(2) of the second subset,
- at least two weft threads S1(2) and S2(2) of the second subset,
- at least one weft thread S1(3) of the third subset.

In the case of the textile substrate 1G, the arrangement of the warp threads K1(1), K2(1), K3(1), K4(1), K5(1), K6(1) and the weft threads S1(1) and S2(1) of the first subset extending through the region 1-1 and of the warp threads K1(2), K2(2), K3(2), K4(2), K5(2), K6(2) and the weft threads S1(2) and S2(2) of the second subset extending through the region 1-1 relative to one another is identical to the arrangement of the corresponding warp threads and weft threads of the first subset and the second subset which exists in the case of the textile subset 1E (FIG. 12A).

Unlike the textile substrate 1E, the textile substrate 1G comprises warp threads K(4) and weft threads S (4) of the fourth subset. In the case of the textile substrate 1G, the respective warp threads and weft threads of the fourth subset are arranged in an inner zone IZ (shown as a dotted area in FIG. 12B) which extends between the respective warp threads and weft threads of the first subset and the respective warp threads and weft threads of the second subset.

As in the case of the textile substrate 1E, in the case of the textile substrate 1G the warp threads K1(1), K2(1), K3(1), K4(1), K5(1), K6(1) and weft threads S1(1), S2(1) of the first subset extending through the region 1-1 are bound to one another and form a stable, flatly configured unit which is integrated as a whole into the textile substrate 1G. Accordingly, the warp threads K1(2), K2(2), K3(2), K4(2), K5(2), K6(2) and weft threads S1(1), S2(1) of the second subset extending through the region 1-1 are bound to one another and form a stable, flatly configured unit which is integrated as a whole into the textile substrate 1G.

Figure 12C:
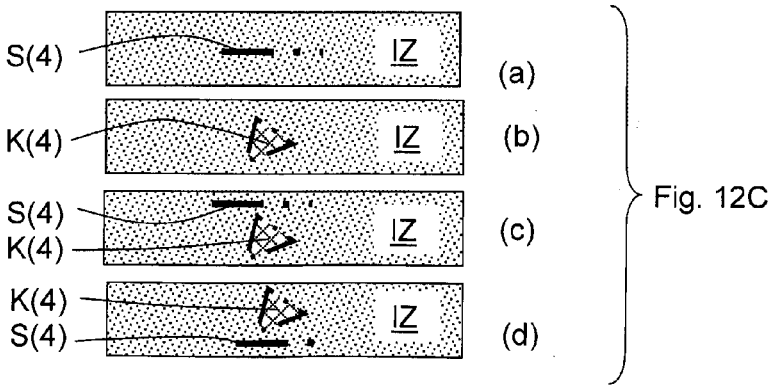
FIG. 12C shows a detail of the seventh embodiment according to FIG. 12B.

The warp threads K(4) and weft threads S(4) of the fourth subset can be arranged in various ways in the inner zone IZ in such a manner that none of the respective warp threads K(4) or weft threads S(4) is bound to the warp threads and weft threads of the first and second subset. FIG. 12C shows examples (a)-(d) for possible arrangement of warp threads K(4) and weft threads S(4) which cross the weft threads or warp threads of the first subset on a side facing the first surface O1 and which cross the weft threads or warp threads of the second subset on a side facing the second subset O2. According to Example (a), exclusively weft threads S(4) can be arranged in the inner zone IZ. According to Example (b), exclusively warp threads K(4) can be arranged in the inner zone IZ. According to Examples (c) and (d) both warp threads K(4) and weft threads S(4) can be arranged in the inner zone IZ.

In the case of the textile substrate 1G, the weft thread S1(3) of the third subset extends through the region 1-1 in such a manner that it crosses over a plurality of warp threads of the first subset extending through the region 1-1 on a side facing the second surface O2 and additionally crosses over a plurality of warp threads of the second subset on a side facing the first surface O1. In this way, all the warp threads and weft threads of the first, second and fourth subset extending through the region 1-1 are connected to one another by means of the weft thread S1(3) of the third subset in the region 1-1 to form a stable layer as long as the weft thread S1(3) is not destroyed.

If, in the case of textile substrate 1G the weft thread S1(3) of the third subset is destroyed according to the invention by application of a suitable chemical and/or physical method, the warp threads and weft threads of the first, second and fourth subset can then be separated. After destruction of the weft thread S1(3) of the third subset, both the warp threads and weft threads of the first subset and also the warp threads and weft threads of the second subset are each present as separate flatly configured units formed from warp threads K1(1), K2(1), K3(1), K4(1), K5(1), K6 (1) and weft threads S1(1) and S2(1) of the first subset bound to one another on the one hand and from warp threads K1(2), K2(2), K3(2), K4(2), K5(2), K6(2) and weft threads S1(2) and S2(2) of the second subset bound to one another on the other hand.

It is also possible to modify the textile substrates 1A, 1C and 1D according to the examples according to FIGS. 11B and 12B by arranging the warp and/or weft threads of the fourth subset in an inner zone formed between the respective warp and/or weft threads of the first subset and the respective warp and/or weft threads of the second subset so that the warp and/or weft threads of the first, second and fourth subset are not bound to one another when the respective weft threads of the third subset are destroyed.

EXAMPLES

Example 1

The textile substrate 1D according to FIG. 6 can be executed, for example, as follows:

Subset 1 comprises warp threads and weft threads of wool and cellulose regenerate.

Subset 2 comprises warp threads and weft threads of polyamide.

Subset 3 comprises weft threads of polyvinyl alcohol (PVA).

Such a textile substrate is suitable in particular as a seat cover textile. The warp threads and weft threads of wool and cellulose regenerate (subset 1) enable an air-conditioned seating and are relevant for moisture regulation. Polyamide (subset 2) increases the abrasion resistance of the textile substrate on one side of the substrate so that this side can preferably be used as a seating surface. Subset 1 can be disposed of in a biological cycle, subset 2 can be processed in a technical cycle.

Example 2

The textile substrate 1D according to FIG. 6 can be executed, for example, as follows:

Subset 1 comprises warp threads and weft threads of wool and cellulose regenerate.

Subset 2 comprises warp threads and weft threads of polyester.

Subset 3 comprises weft threads of polylactide.

Such a textile substrate is suitable in particular as a clothing textile. Subset 1 can be disposed of in a biological cycle, subset 2 can be processed in a technical cycle.

Example 3

The textile substrate 1D according to FIG. 6 can be executed, for example, as follows:

Subset 1 comprises warp threads and weft threads of polyamide.

Subset 2 comprises warp threads and weft threads of aramid.

Subset 3 comprises weft threads of copolyamide.

Such a textile substrate is suitable in particular for manufacturing protective clothing, for example, for bullet-proof vests. Subsets 1 and 2 can be disposed of in various technical cycles.

What is claimed is:

1. A textile substrate (1A, 1B, 1C, 1D, 1E, 1F, 1G) of warp and weft, which comprises a plurality of variously disposable and/or utilisable materials, or a plurality of disposable and/or utilisable materials selected from various utilisation groups, wherein the warp comprises a plurality of warp threads (K1(1), K2(1), K3(1), K4(1), K5(1), K6(1), K1(2), K2(2), K3(2), K4(2), K5(2), K6(2)), and the weft comprises a plurality of weft threads (S1(1), S2(1), S1(2) and S2(2)), wherein a first subset of the totality of all warp threads and weft threads contains one or a plurality of warp threads (K1(1), K2(1), K3(1), K4(1), K5(1), K6(1)) and one or a plurality of weft threads (S1(1), S2(1)) and each warp thread of the first subset, and each weft thread of the first subset, consists of a first of the variously disposable and/or utilisable materials, or of a disposable and/or utilisable material selected from a first of the various utilisation groups, wherein a second subset of the totality of all warp threads and weft threads contains either one or a plurality of warp threads (K1(2), K2(2), K3(2), K4(2), K5(2), K6(2)), or both one or a plurality of warp threads (K1(2), K2(2), K3(2), K4(2), K5(2), K6(2)), and also one or a plurality of weft threads (S1(2), S2(2)), and each warp thread of the second subset, and, if the second subset contains one or a plurality of weft threads (S1(2), S2(2)), each weft thread of the second subset consists of a second of the variously disposable and/or utilisable materials, or of a disposable and/or utilisable material selected from a second of the various utilisation groups, wherein each warp thread crosses over a plurality of weft threads, and each weft thread crosses over a plurality of warp threads, such that the warp and the weft together form a layer, which on one side has a first surface (O1) and on another side has a second surface (O2) located opposite the first surface (O1), wherein, a third subset of the totality of all warp threads and weft threads contains either one or a plurality of weft threads (S1(3)), or both one or a plurality of warp threads and also one or a plurality of weft threads (S1(3)), and each weft thread of the third subset and, if the third subset contains one or a plurality of warp threads, each warp thread of the third subset, consists of a destructible material, and the layer has at least one region (1-1), through which extend one or a plurality of warp threads (K1(1), K2(1), K3(1), K4(1), K5(1), K6(1)) of the first subset, one or a plurality of weft threads (S1(1), S2(1)) of the first subset, and one or a plurality of warp threads of the second subset, wherein each individual thread of the said warp threads (K1(1), K2(1), K3(1), K4(1), K5(1), K6(1)) of the first subset, which extend through the at least one region (1-1) of the layer, crosses over at least one weft thread (S1(1), S2(1)) of the first subset in the at least one region of the layer, on a side facing towards the second surface (O2), wherein each individual thread of the said warp threads (K1(2), K2(2), K3(2), K4(2), K5(2), K6(2)) of the second subset, which extend through the at least one region of the layer, crosses over each individual thread of the said weft threads (S1(1), S2(1)) of the first subset, which extend through the at least one region of the layer, on a side facing towards the first surface (O1), wherein the third subset contains at least one weft thread (S1(3)), which extends through the at least one region of the layer, and is arranged such that the said at least one weft thread (S1(3)) of the third subset crosses over, in the at least one region of the layer, at least one warp thread (K1(1)) of the first subset, on a side facing towards the second surface (O2), and crosses over at least one warp thread (K1(2)) of the second subset, on a side facing towards the first surface (O1), such that the said at least one warp thread of the second subset, in the at least one region of the layer, is bound to the first subset, wherein the destructible material of the at least one weft thread (S1(3)) of the third subset is configured to be destroyable by means of a chemical and/or physical method, such that the second subset, in the at least one region of the layer, is no longer bound to the first subset.

2. A textile substrate of warp and weft, which comprises a plurality of variously disposable and/or utilisable materials, or a plurality of disposable and/or utilisable materials selected from a plurality of various utilisation groups, wherein the warp comprises a plurality of warp threads, and the weft comprises a plurality of weft threads, wherein a first subset of the totality of all warp threads and weft threads contains one or a plurality of warp threads and one or a plurality of weft threads, and each warp thread of the first subset and each weft thread of the first subset consists of a first of the variously disposable and/or utilisable materials, or of a disposable and/or utilisable material selected from a first of the various utilisation groups, wherein a second subset of the totality of all warp threads and weft threads contains either one or a plurality of weft threads, or both one or a plurality of warp threads, and also one or a plurality of weft threads, and each weft thread of the second subset and, if the second subset contains one or a plurality of warp threads, each warp thread of the second subset, consists of a second of the variously disposable and/or utilisable materials, or of a disposable and/or utilisable material selected from a second of the various utilisation groups, wherein each warp thread crosses over a plurality of weft threads, and each weft thread crosses over a plurality of warp threads, such that the warp and the weft together form a layer, which on one side has a first surface (O1) and on another side has a second surface (O2) located opposite the first surface (O1), wherein, a third subset of the totality of all warp threads and weft threads contains either one or a plurality of warp threads, or both one or a plurality of warp threads, and also one or a plurality of weft threads, and each warp thread of the third subset and, if the third subset contains one or a plurality of weft threads, each weft thread of the third subset, consists of a destructible material, and the layer has at least one region, through which extend one or a plurality of the warp threads of the first subset, one or a plurality of weft threads of the first subset, and one or a plurality of the weft threads of the second subset, wherein each individual thread of the said weft threads of the first subset, which extend through the at least one region of the layer, crosses over at least one warp thread of the first subset, in the at least one region of the layer, on a side facing towards the second surface (O2), wherein each individual thread of the said weft threads of the second subset, which extend through the at least one region of the layer, crosses over each individual thread of the said warp threads of the first subset, which extend through the at least one region of the layer, on a side facing towards the first surface (O1), wherein the third subset contains at least one warp thread, which extends through the at least one region of the layer, and is arranged such that the said at least one warp thread of the third subset, in the at least one region of the layer, crosses over at least one weft thread of the first subset on a side facing towards the second surface (O2), and crosses over at least one weft thread of the second subset on a side facing towards the first surface (O1), such that the said at least one weft thread of the second subset, in the at least one region of the layer, is bound to the first subset, wherein the destructible material of the at least one warp thread of the third subset is configured to be destroyable by means of a chemical and/or physical method, such that the second subset, in the at least one region of the layer, is no longer bound to the first subset.

3. The textile substrate (1B, 1D, 1F) in accordance with claim 1, wherein the second subset contains a plurality of warp threads (K1(2), K2(2), K3(2), K4(2), K5(2), K6(2)), which extend through the at least one region (1-1) of the layer, and the second subset contains at least one weft thread (S1(2)), wherein the said at least one weft thread (S1(2)) of the second subset extends through the at least one region of the layer, and, in the at least one region of the layer, crosses over one or a plurality of warp threads (K2(2), K4(2), K6(2)) of the second subset on a side facing towards the first surface (O1), and crosses over one or a plurality of warp threads (K1(2), K3(2), K5(2)) of the second subset on a side facing towards the second surface (O2), wherein each of the said warp threads (K1(2), K2(2), K3(2), K4(2), K5(2), K6(2)) of the second subset, which extend through the at least one region of the layer, is crossed over on the side facing towards the first surface (O1) by at least one of the following weft threads: (i) the at least one weft thread (S1(2)) of the second subset, (ii) the at least one weft thread (S1(3)) of the third subset.

4. The textile substrate (1B) in accordance with claim 3, wherein the first subset contains a plurality of warp threads (K1(1), K2(1), K3(1), K4(1), K5(1), K6(1)), which extend through the at least one region (1-1) of the layer, and which the at least one weft thread (S1(3)) of the third subset crosses over, in the at least one region of the layer, on a side facing towards the second surface (O2), and the first subset contains one or a plurality of weft threads (S1(1), which extend through the at least one region (1-1) of the layer, and, in the at least one region of the layer, cross over the said warp threads (K1(1), K2(1), K3(1), K4(1), K5(1), K6(1)) of the first subset, which extend through the at least one region of the layer, on a side facing towards the first surface (O1).

5. The textile substrate (1C, 1D, 1E, 1G) in accordance with claim 1, wherein the first subset contains a plurality of warp threads (K1(1), K2(1), K3(1), K4(1), K5(1), K6(1)), which extend through the at least one region of the layer, and the first subset contains at least two weft threads (S1(1), S2(1)), which extend through the at least one region of the layer, wherein each of the at least two weft threads of the first subset crosses over, in the at least one region of the layer, one or a plurality of the warp threads of the first subset on a side facing towards the first surface (O1), and crosses over one or a plurality of the warp threads of the first subset on a side facing towards the second surface (O2), such that each individual thread of the said warp threads (K1(1), K2(1), K3(1), K4(1), K5(1), K6(1)) of the first subset, which extend through the at least one region of the layer, in the at least one region of the layer, on the side facing towards the first surface (O1), is crossed over by one of the at least two weft threads (S1(1), S2(1)) of the first subset, and, on the side facing towards the second surface (O2), is crossed over by the other of the at least two weft threads of the first subset.

6. The textile substrate (1C, 1D, 1E, 1G) in accordance with claim 5, wherein the second subset contains a plurality of warp threads (K1(2), K2(2), K3(2), K4(2), K5(2), K6(2)), which extend through the at least one region of the layer, and are crossed over by the at least one weft thread (S1(3)) of the third subset on a side facing towards the first surface (O1).

7. The textile substrate (1D) in accordance with claim 5, wherein the second subset contains a plurality of warp threads (K1(2), K2(2), K3(2), K4(2), K5(2), K6(2)), which extend through the at least one region of the layer, and the second subset contains at least one weft thread (S1(2)), wherein the said at least one weft thread (S1(2)) of the second subset extends through the at least one region of the layer, and, in the at least one region of the layer, crosses over one or a plurality of warp threads (K2(2), K4(2), K6(2)) of the second subset on a side facing towards the first surface (O1), and crosses over one or a plurality of warp threads (K1(2), K3(2), K5(2)) of the second subset on a side facing towards the second surface (O2), wherein each of the said warp threads (K1(2), K2(2), K3(2), K4(2), K5(2), K6(2)) of the second subset, which extend through the at least one region of the layer, is crossed over on the side facing towards the first surface (O1) by at least one of the following weft threads: (i) the at least one weft thread (S1(2)) of the second subset, (ii) the at least one weft thread (S1(3)) of the third subset.

8. The textile substrate (1E, 1G) in accordance with claim 5, wherein the second subset contains a plurality of warp threads (K1(2), K2(2), K3(2), K4(2), K5(2), K6(2)), which extend through the at least one region of the layer, and the second subset contains at least two weft threads (S1(2)), S2(2)) which extend through the at least one region of the layer, wherein each of the at least two weft threads (S1(2), S2(2)) of the second subset crosses over, in the at least one region of the layer, one or a plurality of the warp threads (K1(2), K2(2), K3(2), K4(2), K5(2), K6(2)) of the second subset on a side facing towards the first surface (O1), and crosses over one or a plurality of the warp threads of the second subset on a side facing towards the second surface (O2), such that each individual thread of the said warp threads (K1(2), K2(2), K3(2), K4(2), K5(2), K6(2)) of the second subset, which extend through the at least one region of the layer, in the at least one region of the layer, on the side facing towards the first surface (O1), is crossed over by one of the at least two weft threads of the second subset, and on the side facing towards the second surface (O2) is crossed over by the other of the at least two weft threads of the second subset, and the at least one weft thread (S1(3)) of the third subset crosses over one or a plurality of the said warp threads (K1(2), K2(2), K3(2), K4(2), K5(2), K6(2)) of the second subset, which extend through the at least one region of the layer, on a side facing towards the first surface (O1), and crosses over one or a plurality of the said warp threads (K1(1), K2(1), K3(1), K4(1), K6(1)) of the first subset, which extend through the at least one region of the layer, on a side facing towards the second surface (O2).

9. The textile substrate in accordance with claim 2, wherein the second subset contains a plurality of weft threads, which extend through the at least one region of the layer, and the second subset contains at least one warp thread, wherein the said at least one warp thread of the second subset extends through the at least one region of the layer, and, in the at least one region of the layer, crosses over one or a plurality of weft threads of the second subset on a side facing towards the first surface (O1), and crosses over one or a plurality of weft threads of the second subset on a side facing towards the second surface (O2), wherein each of the said weft threads of the second subset, which extend through the at least one region of the layer, is crossed over, on the side facing towards the first surface (O1), by at least one of the following warp threads: (i) the at least one warp thread of the second subset, (ii) the at least one warp thread of the third subset.

10. The textile substrate in accordance with claim 9, wherein the first subset contains a plurality of weft threads, which extend through the at least one region of the layer, and which the at least one warp thread of the third subset crosses over in the at least one region of the layer on a side facing towards the second surface (O2), and the first subset contains one or a plurality of warp threads, which extend through the at least one region of the layer, and in the at least one region of the layer cross over the said weft threads of the first subset, which extend through the at least one region of the layer, on a side facing towards the first surface (O1).

11. The textile substrate in accordance with claim 2, wherein the first subset contains a plurality of weft threads, which extend through the at least one region of the layer, and the first subset contains at least two warp threads, which extend through the at least one region of the layer, wherein each of the at least two warp threads of the first subset, in the at least one region of the layer, crosses over one or a plurality of the weft threads of the first subset on a side facing towards the first surface (O1), and crosses over one or a plurality of the weft threads of the first subset on a side facing towards the second surface (O2), such that each individual thread of the said weft threads of the first subset, which extend through the at least one region of the layer, in the at least one region of the layer on the side facing towards the first surface (O1) is crossed over by one of the at least two warp threads of the first subset, and on the side facing towards the second surface (O2) is crossed over by the other of the at least two warp threads of the first subset.

12. The textile substrate in accordance with claim 11, wherein the second subset contains a plurality of weft threads, which extend through the at least one region of the layer, and are crossed over by the at least one warp thread of the third subset on a side facing towards the first surface (O1).

13. The textile substrate in accordance with claim 11, wherein the second subset contains a plurality of weft threads, which extend through the at least one region of the layer, and the second subset contains at least one warp thread, wherein the said at least one warp thread of the second subset extends through the at least one region of the layer, and, in the at least one region of the layer, crosses over one or a plurality of weft threads of the second subset on a side facing towards the first surface (O1), and crosses over one or a plurality of weft threads of the second subset on a side facing towards the second surface (O2), wherein each of the said weft threads of the second subset, which extend through the at least one region of the layer, is crossed over, on the side facing towards the first surface (O1), by at least one of the following warp threads: (i) the at least one warp thread of the second subset, (ii) the at least one warp thread of the third subset.

14. The textile substrate in accordance with claim 11, wherein the second subset contains a plurality of weft threads, which extend through the at least one region of the layer, and the second subset contains at least two warp threads, which extend through the at least one region of the layer, wherein each of the at least two warp threads of the second subset, in the at least one region of the layer, crosses over one or a plurality of the weft threads of the second subset on a side facing towards the first surface (O1), and crosses over one or a plurality of the weft threads of the second subset on a side facing towards the second surface (O2), such that each individual thread of the said weft threads of the second subset, which extend through the at least one region of the layer, in the at least one region of the layer, on the side facing towards the first surface (O1), is crossed over by one of the at least two warp threads of the second subset, and on the side facing towards the second surface (O2) is crossed over by the other of the at least two warp threads of the second subset, and the at least one warp thread of the third subset crosses over one or a plurality of the said weft threads of the second subset, which extend through the at least one region of the layer, on a side facing towards the first surface (O1), and crosses over one or a plurality of the said weft threads the first subset, which extend through the at least one region of the layer, on a side facing towards the second surface (O2).

15. The textile substrate in accordance with claim 1, wherein the destructible material of the weft thread, or the warp thread, of the third subset is configured to be destroyable by means of one of the following chemical and/or physical methods, or by a combination of these methods:

(i) subjection of the textile substrate, or parts of the textile substrate, to a solvent, wherein the weft thread or the warp thread of the third subset consists of a material that dissolves in the solvent;

(ii) subjection of the textile substrate, or parts of the textile substrate, to a solvent, and heating of the textile substrate and/or the solvent to a prescribed temperature, wherein the weft thread, or the warp thread, of the third subset consists of a material that dissolves in the solvent at the prescribed temperature;

(iii) subjection of the textile substrate, or parts of the textile substrate, to a solvent, and heating of the textile substrate and/or the solvent to a prescribed temperature at a prescribed pressure, wherein the weft thread, or the warp thread, of the third subset consists of a material that dissolves in the solvent at the prescribed temperature and the prescribed pressure;

(iv) heating of the textile substrate, or parts of the textile substrate, to a prescribed temperature, wherein the weft thread, or the warp thread, of the third subset consists of a material that melts, and/or decomposes, and/or glazes, and/or becomes brittle, at the prescribed temperature;

(v) cooling of the textile substrate down to a prescribed temperature, wherein the weft thread, or the warp thread, of the third subset consists of a material that becomes brittle, and/or suffers a cold fracture, and/or disintegrates, and/or shatters, at the prescribed temperature.

16. The textile substrate in accordance with claim 15, wherein the weft thread, or the warp thread, of the third subset consists of one of the following materials, or a mixture of the said materials: polyvinyl alcohol, starch, polylactide, copolyamide, copolyester, copolyolefins, acetate, polyolefins.

17. The textile substrate in accordance with claim 1, wherein the first of the variously disposable and/or utilisable materials is a natural fibre, or a natural chemical fibre, or a material that is configured to be disposable of or utilisable in a biological cycle, or the first of the various utilisation groups comprises natural fibres, and/or natural chemical fibres, and/or materials that are configured to be utilisable in a biological cycle.

18. The textile substrate in accordance with claim 1, wherein the second of the variously disposable and/or utilisable materials consists of a synthetic material, or a material that is configured to be disposable of or utilisable in a technical cycle, or the second of the various utilisation groups comprises synthetic materials, and/or materials that are configured to be disposable of and/or utilisable in a technical cycle.

19. The textile substrate in accordance with claim 1, wherein the first of the variously disposable and/or utilisable materials, and the second of the variously disposable and/or utilisable materials are configured to be disposable of and/or utilisable in various technical cycles, or each of the materials of the various utilisation groups is configured to be disposed of and/or utilisable in various technical cycles.

20. The textile substrate in accordance with claim 1, embodied as a woven fabric in dobby weaving technology, jacquard technology, leno technology, pile technology, wire weaving technology, or broché weaving technology.

21. The textile substrate in accordance with claim 1, being configured as a seat cover textile, a furnishing textile, a clothing textile, a functional textile, a protective textile, a safety textile, a wall covering textile, a floor covering textile or a medicinal textile, or as a component of a seat cover textile, a furnishing textile, a clothing textile, a functional textile, a protective textile, a safety textile, a wall covering textile, a floor covering textile or a medicinal textile.

22. A method for the processing of a textile substrate in accordance with claim 1, with the following steps:

execution of a chemical and/or physical method for the destruction of the warp threads or weft threads (S1(3)) of the third subset of the totality of all warp threads and weft threads;

separation of the warp threads (K1(2), K2(2), K3(2), K4(2), K5(2), K6(2)), and/or weft threads (S1(2), S2(2)) of the second subset of the totality of all warp threads and weft threads, from the warp threads (K1(1), K2(1), K3(1), K4(1), K5(1), K6(1)) and/or weft threads (S1(1), S2(1)) of the first subset of the totality of all warp threads and weft threads.

23. The method in accordance with claim 22, wherein the warp threads and/or weft threads of the second subset after the separation are disposed of or utilised separately from the warp threads and/or weft threads of the first subset.

24. The textile substrate in accordance with claim 2, wherein the destructible material of the weft thread, or the warp thread, of the third subset is configured to be destroyable by means of one of the following chemical and/or physical methods, or by a combination of these methods:

(i) subjection of the textile substrate, or parts of the textile substrate, to a solvent, wherein the weft thread or the warp thread of the third subset consists of a material that dissolves in the solvent;

(ii) subjection of the textile substrate, or parts of the textile substrate, to a solvent, and heating of the textile substrate and/or the solvent to a prescribed temperature, wherein the weft thread, or the warp thread, of the third subset consists of a material that dissolves in the solvent at the prescribed temperature;

(iii) subjection of the textile substrate, or parts of the textile substrate, to a solvent, and heating of the textile substrate and/or the solvent to a prescribed temperature at a prescribed pressure, wherein the weft thread, or the warp thread, of the third subset consists of a material that dissolves in the solvent at the prescribed temperature and the prescribed pressure;

(iv) heating of the textile substrate, or parts of the textile substrate, to a prescribed temperature, wherein the weft thread, or the warp thread, of the third subset consists of a material that melts, and/or decomposes, and/or glazes, and/or becomes brittle, at the prescribed temperature;

(v) cooling of the textile substrate down to a prescribed temperature, wherein the weft thread, or the warp thread, of the third subset consists of a material that becomes brittle, and/or suffers a cold fracture, and/or disintegrates, and/or shatters, at the prescribed temperature.

25. The textile substrate in accordance with claim 24, wherein the weft thread, or the warp thread, of the third subset consists of one of the following materials, or a mixture of the said materials: polyvinyl alcohol, starch, polylactide, copolyamide, copolyester, copolyolefins, acetate, polyolefins.

26. The textile substrate in accordance with claim 2, wherein the first of the variously disposable and/or utilisable materials is a natural fibre, or a natural chemical fibre, or a material that is configured to be disposable of or utilisable in a biological cycle, or the first of the various utilisation groups comprises natural fibres, and/or natural chemical fibres, and/or materials that is configured to be utilisable in a biological cycle.

27. The textile substrate in accordance with claim 2, wherein the second of the variously disposable and/or utilisable materials consists of a synthetic material, or a material that is configured to be disposable of or utilisable in a technical cycle, or the second of the various utilisation groups comprises synthetic materials, and/or materials that are configured to be disposable of and/or utilisable in a technical cycle.

28. The textile substrate in accordance with claim 2, wherein the first of the variously disposable and/or utilisable materials, and the second of the variously disposable and/or utilisable materials are configured to be disposable of and/or utilisable in various technical cycles, or each of the materials of the various utilisation groups is configured to be disposable of and/or utilisable in various technical cycles.

29. The textile substrate in accordance with claim 2, embodied as a woven fabric in dobby weaving technology, jacquard technology, leno technology, pile technology, wire weaving technology, or broché weaving technology.

30. The textile substrate in accordance with claim 2, being configured as a seat cover textile, a furnishing textile, a clothing textile, a functional textile, a protective textile, a safety textile, a wall covering textile, a floor covering textile or a medicinal textile, or as a component of a seat cover textile, a furnishing textile, a clothing textile, a functional textile, a protective textile, a safety textile, a wall covering textile, a floor covering textile or a medicinal textile.

31. A method for the processing of a textile substrate in accordance with claim 2, with the following steps:

execution of a chemical and/or physical method for the destruction of the warp threads or weft threads (S1(3)) of the third subset of the totality of all warp threads and weft threads;

separation of the warp threads (K1(2), K2(2), K3(2), K4(2), K5(2), K6(2)), and/or weft threads (S1(2), S2(2)) of the second subset of the totality of all warp threads and weft threads, from the warp threads (K1(1), K2(1), K3(1), K4(1), K5(1), K6(1)) and/or weft threads (S1(1), S2(1)) of the first subset of the totality of all warp threads and weft threads.

32. The method in accordance with claim 31, wherein the warp threads and/or weft threads of the second subset after the separation are disposed of or utilised separately from the warp threads and/or weft threads of the first sub set.

* * * * *